US006457384B1

(12) United States Patent
Cox et al.

(10) Patent No.: US 6,457,384 B1
(45) **Date of Patent: *Oct. 1, 2002**

(54) CAPPED HEAD HAMMER

(75) Inventors: Michael L. Cox, Lewistown, IL (US); Ted Jerominski, Woodstock, IL (US)

(73) Assignee: Vaughan & Bushnell Manufacturing Company, Herbon, IL (US)

( * ) Notice: Subject to any disclaimer, the term of this patent is extended or adjusted under 35 U.S.C. 154(b) by 72 days.

This patent is subject to a terminal disclaimer.

(21) Appl. No.: 09/708,206

(22) Filed: Nov. 8, 2000

Related U.S. Application Data

(63) Continuation-in-part of application No. 09/512,398, filed on Feb. 24, 2000.

(51) Int. Cl.[7] ..... B25D 1/00
(52) U.S. Cl. ..... 81/22; 81/25
(58) Field of Search ..... 81/20, 21, 22, 81/25

(56) References Cited

U.S. PATENT DOCUMENTS

| | | | | |
|---|---|---|---|---|
| 1,045,145 A | * | 11/1912 | Hubbard | 81/22 |
| 1,732,985 A | * | 10/1929 | Peters | 81/22 |
| 1,781,344 A | * | 11/1930 | Salazar | 81/22 |
| 1,792,153 A | * | 2/1931 | Evich | 81/25 |
| 2,198,764 A | * | 4/1940 | Edwards | 81/22 |
| 2,491,295 A | * | 12/1949 | Anderson | 81/25 |
| 2,952,284 A | * | 9/1960 | Nichols et al. | 81/19 |
| 3,148,716 A | * | 9/1964 | Vaughan, Jr. | 81/22 |

* cited by examiner

*Primary Examiner*—Eileen P. Morgan
*Assistant Examiner*—Joni B. Danganan
(74) *Attorney, Agent, or Firm*—David M. Thimmig; Mayer, Brown, Rowe & Maw

(57) ABSTRACT

Retaining means for holding a fastening cross-pin that holds a removable cap mounted to a pole of a hammer thus providing a selected type of cap impact face for the hammer head. The cap forms a chamber and the pole is removably slidably fitted into the pole chamber. The fastening cross-pin is removably positioned in cap pin holes in the cap cylindrical wall and to a pole pin hole so as to removably secure the cap to the pole and also so as to allow the pole to move relative to the cap in the longitudinal dimension between an impact mode position of the cap impact face against a workpiece and a static mode position of the cap impact face remote from the workpiece. A biasable pad for absorbing shock is positioned within the chamber formed in the cap between the cap impact face and the pole. The fastening cross-pin extends through the pole pin hole and is connected to the cap side walls. The fastening cross-pin is in contact with the front surface of the pole pin hole in the static mode and moves to a free position in the pole pin hole in the impact mode so that the cross-pin avoids shear during the impact mode. Two types of retaining means are described: one type is an external retaining ring that is set into a groove around the cap that is aligned with both ends of the cross-pin; another type is an internal expansion retaining ring that is also the fastening cross-pin that is biased against the pin holes in the cap cylindrical wall.

32 Claims, 11 Drawing Sheets

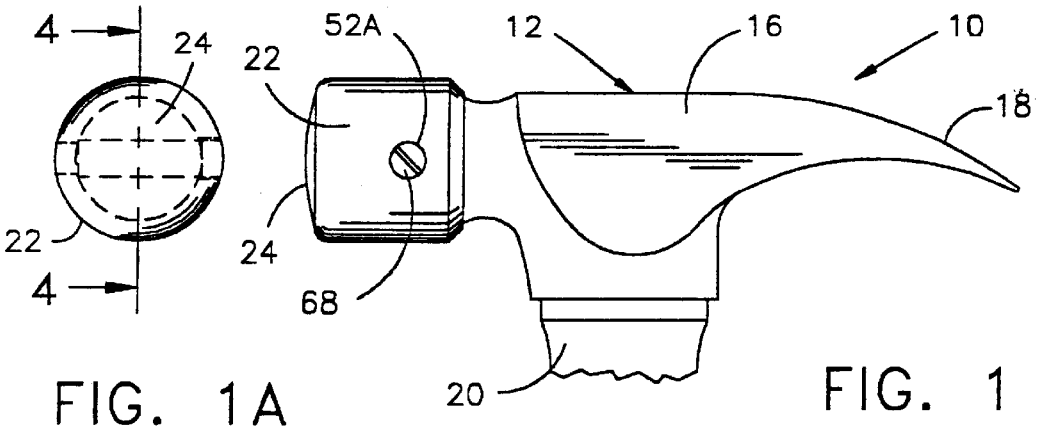
FIG. 1A
FIG. 1
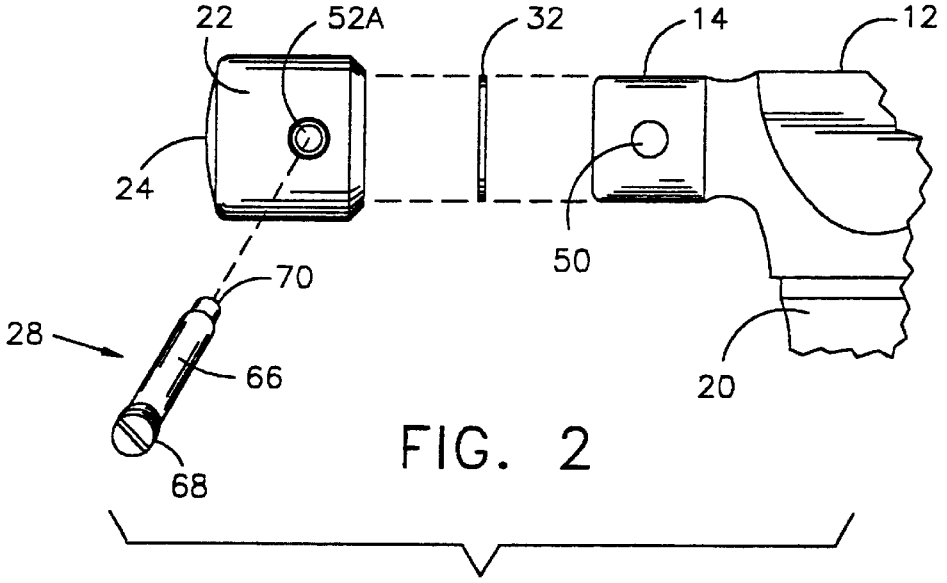
FIG. 2
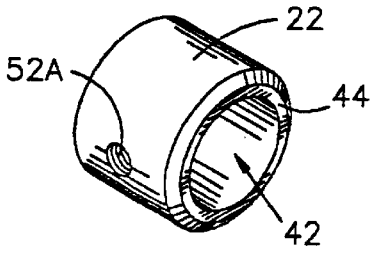
FIG. 2A
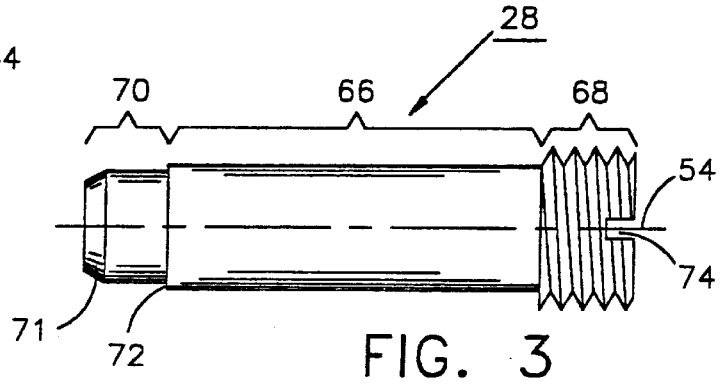
FIG. 3

CAPPED HEAD HAMMER

RELATED APPLICATION

The present invention is a continuation-in-part application of U.S. patent application Ser. No. 09/512,398, filed on Feb. 24, 2000, pending.

FIELD OF THE INVENTION

The present invention relates to the field of hammers and more particularly to the field of replaceable caps for hammers.

DESCRIPTION OF THE PRIOR ART

The striking face of a hammer is often subjected to forces that require extra toughness and hardness. Because of the heavy duty usage of certain hammers, the impact faces wear out more rapidly than normal hammers. One example of this type of hammer is the framing hammer, used in the art of house building. Such types of hammer are heavier than the average hammer, and in order to eliminate the cost of a manufacturing an entire hammer that includes a unitary head that meets the toughness required, it is known in the art to attach a separate hammer head portion, or capped head, or cap, at the end area, or pole, of the hammer head. Such caps, which are often made of a strong but heavy metal such as stainless steel, are known in the art.

Hammers have various types of striking faces, for example, flat faces and knurled faces. In addition, hammers having heavy duty striking faces often require different versions of the rear region of the hammer head, for example, a claw and a ball pein. A replaceable cap having a tough striking face thus has another application.

In another area of the art of hammers, shock absorbing structures that reduce shock to the hands and arms of users during impact are known. Combining such shock absorbing structures with a replaceable cap is also known.

Patents relating to the art of hammers that disclose various aspects of capped heads are as follows:

1) Patents that disclose detachable, or replaceable, head caps combined with shock-absorbing cushions or washers known in the art of hammers are as follows:

U.S. Pat. No. 2,518,059 issued to M. Permerl on Aug. 8, 1950, discloses a mallet having interchangeable percussion heads 14 and 17 removably screwed to a mallet head 10. Interposed between the inner end face of percussion members 14 and 17 are washers 16 and 23, respectively, which are made of a resilient material such as rubber.

U.S. Pat. No. 3,000,414 issued to N. Cordis on Sep. 19, 1961, discloses a hammer 10 having a hammer head 12 and a replaceable, or "floating", striking head 15 provided with an elongated stud 16 that is accommodated by a bore 17 in hammer head 12. A flexible, resilient sleeve 20 connects floating head 15 to hammer head 12. FIGS. 2–5 show a resilient sleeve 29 that includes a supplemental integral cap 23 providing a rim 24 about striking head 15. Sleeve 20 is capable of withstanding the impact and the constant flexing in its cushioning action. Sleeve 20 also grips the snub-nose tip 14 of hammer head 12 and holds striking head 15 in an alternative embodiment as shown in FIGS. 2–5.

2) A patent disclosing a removable and replaceable capped head is as follows:

U.S. Pat. No. 2,515,431 issued to C. A. Ulfves on Jul. 18, 1950, discloses a unitary detachable hammer tip set forth in FIG. 2 that includes a core 16, a ring 30, and arcuate spring fmgers 24 having reversibly bent gripping elements 26. The entire detachable tip is removably attached to conventional hammer head 10 as shown in FIG. 1.

3) Patents relating to the art of hammers disclosing hammers with cushions or washers or structures for absorbing shock between a separate but non-replaceable cap and the hammer head proper are as follows:

U.S. Pat. No. 1,045,145 issued to E. O. Hubbard on Nov. 26, 1912, discloses a capped hammer head 1 provided with a shock-absorbing rubber cushion 19 for a separate head proper, or cap 10. FIG. 1 shows a cap 10 has a threaded stud 13 screwed into a retaining head 1 mounted inside a sleeve 5 that in turn is threaded onto a reduced threaded portion 4 of head 1. FIGS. 4 and 5 show variations on the particular structure.

U.S. Pat. No. 1,732,985 issued to R. H. Peters on Oct. 22, 1929, discloses a hammer attachment, or cap, including a sleeve 1 and a rubber striking head 7 is secured by clamping means 12 upon a hammer head 15 with a washer 9 fit against a seat 3 connected to striking head 7 positioned within sleeve 1 is described. It is apparent that washer 9 absorbs pressure exerted by hammer head 15.

U.S. Pat. No. 2,198,764, issued to B. E. Edwards on Apr. 30, 1940, discloses a metal working hammer having a hammer head 6 having a floating striking element 11 that is movably secured to a stationary hammer striking element 8 positioned in a cylindrical body portion 12 having a bottom, or strike face 13. A shock-absorbing element, or cushion, 15, is housed in cylindrical body portion 12 between bottom strike face 13 and stationary element 8.

U.S. Pat. No. 2,592,883 issued to C. J. Fisher on Apr. 15, 1952, discloses a hand hammer body 10 having a hammer head 16 with an arcuate hammer face 18. A resilient striking member 22 made of resilient carbon spring steel or similar material is mounted over arcuate face 18 so that a recess is defined between striking member 22 and arcuate face 18. In use, when an indented piece of metal is struck with the hammer, the resilient member 22 will flex inwardly toward the recessed face 18 tending to close the hollow space between face 18 and member 22. Immediately thereafter, the spring action of member 22 with cause the member to flex outwardly again. This inward and outward action imparts a spring-like action and resilience to the hammer head.

U.S. Pat. No. 3,148,716 issued to H. A. Vaughan, Jr. on Sep. 15, 1964, discloses a composite hammer head 10 comprised of a main body portion 11 and an impact tip, or cap 12. The front end face 64 of main body portion 11 forms a socket 62. Impact tip 12 is metallic and includes a striking face 46 and a rear tapered shank 44 press-fitted into socket 62. A washer 66 formed of a shock-absorbing material surrounding the base of shank 44 is interposed between striking head 42 and front end face 64. The combined thickness of washer 66 and the depth of socket 62 is slightly greater than the axial extent of shank 44 so that a sealed air pocket 72 is created in the bottom region of socket 62 absorbs some of the impact that is imparted to impact tip 12.

U.S. Pat. No. 2,884,969 issued to C. M Lay on May 5, 1959, entitled "Hammer Construction with Shock Absorbing Means" is cited in U.S. Pat. No. 3,148,176 to Vaughan for the purpose of describing the effects of impact creating vibration effects in the vicinity of the claw region of a carpenter's claw hammer.

SUMMARY OF THE INVENTION

It is an object of the present invention to provide a replaceable cap for a hammer that has a fastening pin that is free of any shearing pressure during the impact stoke of the hammer.

It another object of the present invention to provide a replaceable cap for a hammer that allows a user to replace a cap with one type of striking face with another cap with another type of striking face or to replace the hammer head of a replaceable cap with another type of hammer head, for example, a claw hammer with a ball pein hammer.

It is yet another object of the present invention to provide a replaceable cap for a hammer that has a shock absorbing pad.

It is yet another object of the present invention to provide a replaceable cap for a hammer head that has a pole that is slidably mounted within the chamber of the cap with the pole movable relative to the cap between a static mode and an impact mode and that includes a shock-absorbent pad that is biasable and able to move the pole that has moved from the static mode against the pad toward the cap striking face and is further able to self-biasably return the pole to the static mode with the energy of the self-biasing action being supplied by the energy of the striking action against a workpiece.

It is a further object of this invention to provide a retaining ring for holding the fastening pin for holding the replaceable cap for the hammer head described above.

It is yet another object of this invention to provide an external type of retaining ring for holding the fastening pin described above.

It is yet another object of this invention to provide an internal expansion retaining ring for holding the fasting pin described above.

In accordance with these objects and other objects that will become apparent in the course of this disclosure, there is provided retaining means for holding a fastening cross-pin that holds a removable cap mounted to a pole of a hammer thus providing a selected type of cap impact face for the hammer head. The cap forms a chamber and the pole is removably slidably fitted into the pole chamber. The fastening cross-pin is removably positioned in opposed cap pin holes in the cap cylindrical wall and to a pole pin hole so as to secure the cap to the pole and also so as to allow the pole to move relative to the cap in the longitudinal dimension between an impact mode position of the cap impact face against a workpiece and a static mode position of the cap impact face remote from the workpiece. A biasable pad for absorbing shock is positioned within the chamber formed in the cap between the cap impact face and the pole. The fastening cross-pin extends through the pole pin hole and is connected to the cap side walls. The fastening cross-pin is in contact with the front surface of the pole pin hole in the static mode and moves to a free position in the pole pin hole in the impact mode so that the cross-pin avoids shear during the impact mode. Two types of retaining means are described: one type is an external retaining ring that is set into a groove around the cap that is aligned with both ends of the cross-pin; another type is an internal expansion retaining ring that also the fastening cross-pin that is biased against the pin holes in the cap cylindrical wall.

The present invention will be better understood and the objects and important features, other than those specifically set forth above, will become apparent when consideration is given to the following details and description, which when taken in conjunction with the annexed drawings, describes, illustrates, and shows preferred embodiments or modifications of the present invention and what is presently considered and believed to be the best mode of practice in the principles thereof. Other embodiments or modifications may be suggested to those having the benefit of the teachings therein, and such other embodiments or modifications are intended to be reserved especially as they fall within the scope and spirit of the subjoined claims.

DESCRIPTION OF THE DRAWINGS

FIG. 1 is an elevational side view of the hammer of the present invention with a claw rear region with the handle shown in broken view;

FIG. 1A is a front view of the cap of FIG. 1;

FIG. 2 is an exploded perspective view of the hammer shown in FIG. 1;

FIG. 2A is a perspective view of the cap taken in isolation showing the cap cylindrical chamber;

FIG. 3 is an isolated side view of the fastening pin;

DETAILED DESCRIPTION OF THE INVENTION

Figure 4:
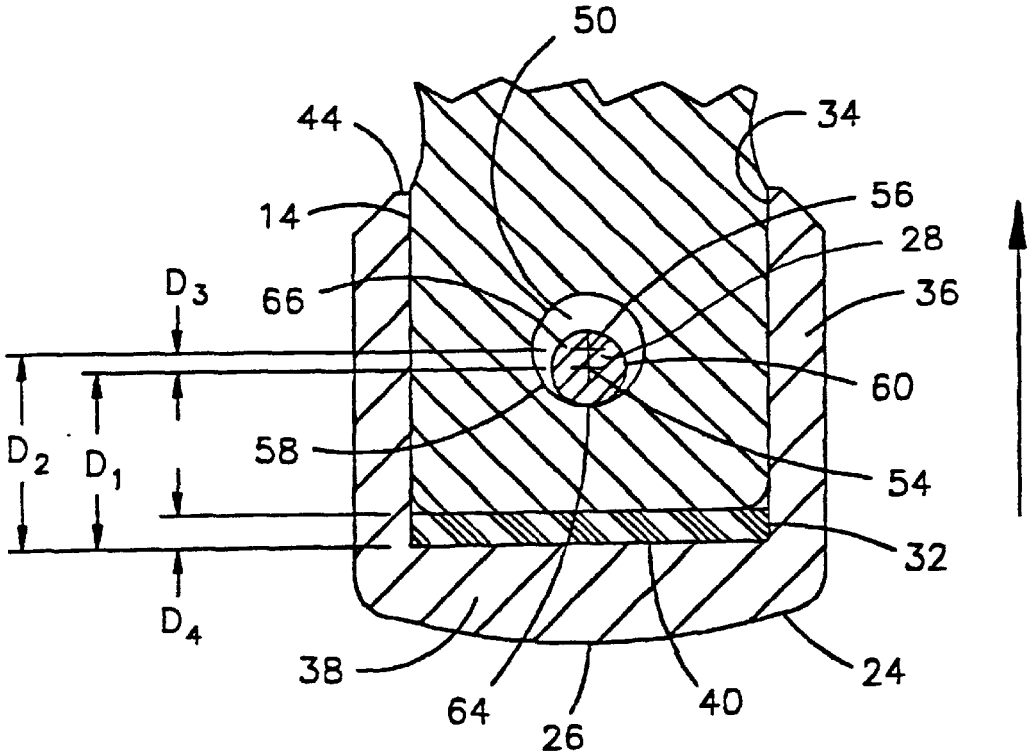
FIG. 4 is a partly sectioned side view of the pole, cap, a biasable pad and fastening pin of the hammer shown in FIGS. 1 and 2 in the static mode.

Reference is now made to the drawings and in particular to FIGS. 1–9 in which identical or similar parts are designated by the same reference numerals throughout.

A hammer 10 shown in FIGS. 1 and 2 includes a hammer head 12 that includes a forward pole 14, a mid-region 16, a rear region claw 18 and a handle 20 connected to mid-region 16. Hammer head 12 has a longitudinal dimension extending from pole 14 to claw 18 with a handle 20 being transverse to the longitudinal dimension. Hammer 10 alrrther includes a cylindrical cap 22 for hammer head 12 with cap 22 being removably fitted over cylindrical pole 14 with the axis of cylindrical cap 22 being axially aligned with the cylindrical axis of cylindrical pole 14. Cap 22 provides a selected type of cap impact face 24 for hammer head 12 so that cap 22 can be removed from hammer head 12 and in particular from pole 14 so that another type of cap can be placed over pole 14. The particular cap impact face 24 shown in FIGS. 1, 2, 4, 5, 6, and 7 is of a type having a slight crown or adz eye, 26, for purposes of exposition only, and in fact cap impact face 24 can be of a number of various types of striking faces known in the art.

Figure 5:
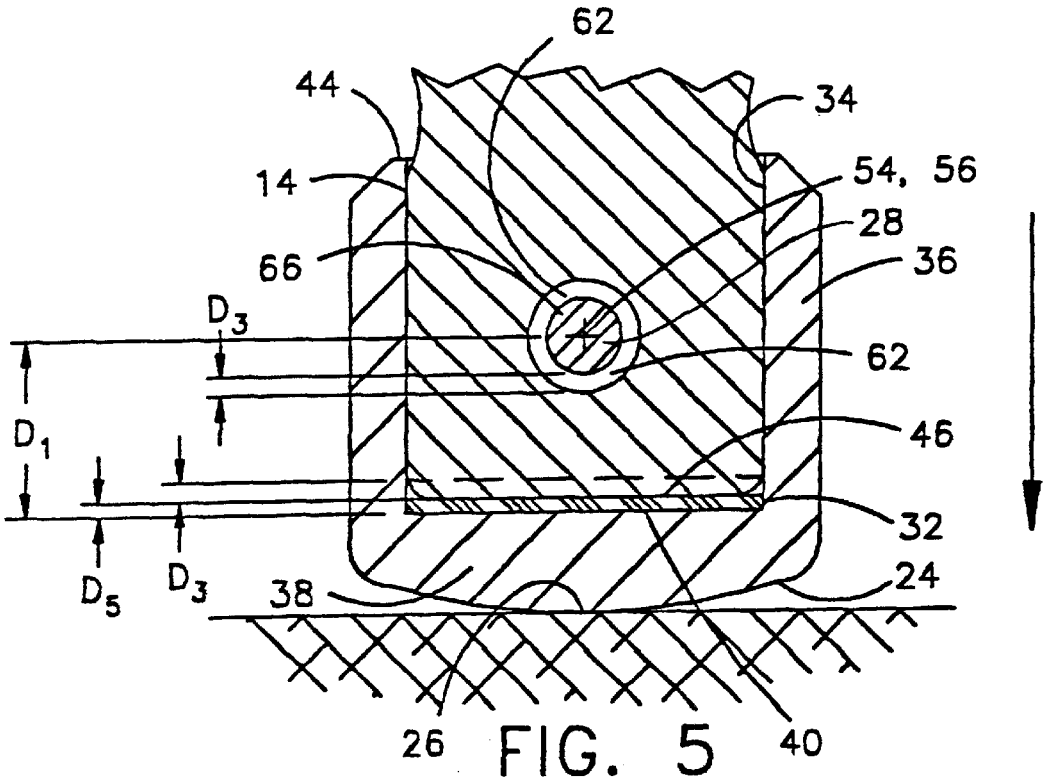
FIG. 5 is a partly sectioned side view of the hammer analogous to the view shown in FIG. 4 in the impact mode with the space formerly occupied by the unbiased biasable pad indicated in phantom line.
Figure 6:
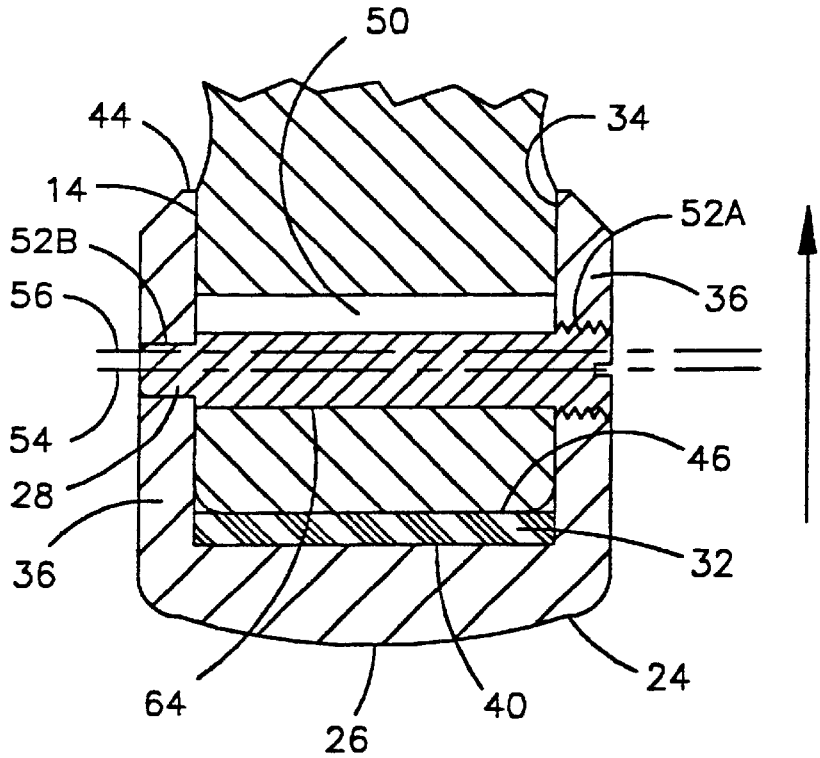
FIG. 6 is a partly sectioned top view of the pole, cap self-biasing and fastening pin of the hammer shown in FIGS. 1 and 2 in the static mode.
Figure 7:
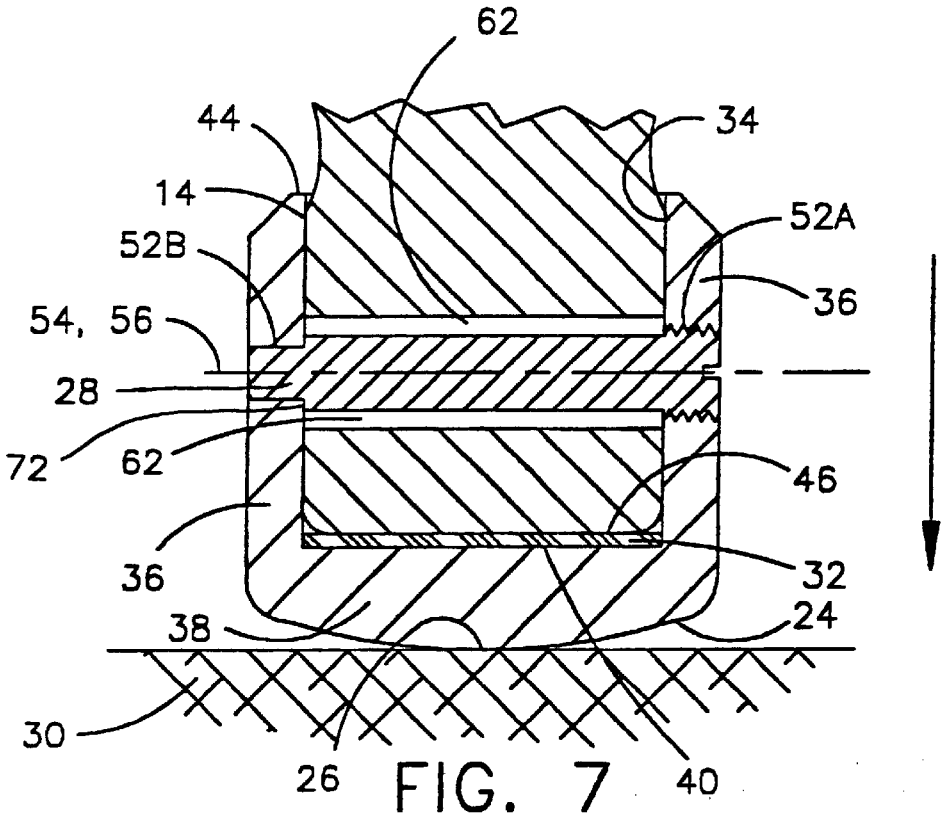
FIG. 7 is partly sectioned view of the hammer analogous to the view shown in FIG. 6 in the impact mode.

As shown in FIGS. 1 and 2 and best seen in FIGS. 4, 5, 6, and 7, cap 22 is removably secured to pole 14 by a fastening cross-pin 28. FIGS. 4 and 6 show pole 14 and cap 22 in a non-impact, or static, mode with cap impact face 24 remote from a workpiece 30 shown in FIGS. 5 and 7. FIGS. 5 and 7 show pole 14 and cap 22 in an impact mode with cap impact face 24 in striking contact with workpiece 30. Cross-pin 28 allows pole 14 to move laterally relative to cap 22 in the longitudinal dimension between the impact mode position and the static mode position.

A shock-absorbing, biasable pad 32 both absorbs shock to hammer head 12 during the impact mode and also returns cap 22 by self-biasing action from the impact mode position shown in FIGS. 5 and 7 to the static mode position shown in FIGS. 4 and 6. Biasable pad 32 is positioned within cap 22 between cap impact face 24 and pole 14. Cap 22 forms a cap cylindrical chamber 34 defined by a longitudinally oriented cap cylindrical side wall 36 and a cap front wall 38 transverse to cap side wall 36. Cap front wall 38 includes cap external impact face 24 with adz eye 26 and an opposed cap planar interior chamber face 40 that is transverse to the axis of cylindrical cap 22. Cap chamber 34 has a circular aperture 42 opposed to cap interior chamber face 40. Circular aperture 42 is defined by the circular rim 44 of cap side wall 36.

Cylindrical pole 14 is slidably fitted to cap 22 within cap chamber 34 with the interior surface of cylindrical cap side wall 36 and is in mutual axially aligned sliding contact with the interior surface of cap cylindrical chamber 34 in the longitudinal direction. Pole 14 has a pole planar front surface 46 that is transverse to the axis of cylindrical pole 14 and that is spaced from cap planar chamber interior face 40. Biasable pad 32 is a disk, or cylindrical, in configuration as seen in FIGS. 4–7 that is axially aligned with pole 14 and cap 22. Biasable pad 32 is made of a resilient material such as rubber that is able to the absorb shock of the impact, or striking mode and thus reduces the shock to the hand and arm of the user. In addition, biasable pad 32 is forced into a biased mode when pole self-biasing capability to return to a non-biased mode so as to biasably force pole 14 away from cap chamber face 40 at the termination of the impact mode, that is, at the end of the striking blow of hammer head 12 against workpiece 30. The space between cap planar chamber face 40 and pole planar front surface 46 varies in response to pole 14 and cap 22 being in the static mode or the impact mode so that biasable pad 32 occupies a larger or a smaller space, respectively, therebetween. The action of pole 14 relative to cap 22 between the static mode and the impact mode is analogous to that of a piston in a cylinder block despite the smallness of the movement. The energy of the impact blow of hammer head 12 against workpiece 30 is partly absorbed by biasable pad 32 to enable biasable pad 32 to force pole 14 back into the static mode during the movement of biasable pad 32 from the biased mode to the unbiased mode. In the static mode of FIGS. 4 and 6, pole planar front surface 46 is in contact with biasable pad 32 so as to maintain a slight compression against biasable pad 32 in the range of 0.002 inch to 0.007 inch.

Pole 14 forms a pole pin hole 50 transverse to the longitudinal, or pole axial, direction. Cap cylindrical side wall 36 forms a pair of opposed cap pin holes 52A and 52B in general alignment with pole pin hole 50. Fastening cross-pin 28 extends through pole pin hole 50 and is removably connected to cap 22 at cap pin holes 52A and 52B. Cross-pin 28 has a cross-pin axis 54 and pole pin hole 50 has a pole pin hole axis 56.

Cross-pin 28 has a cross-pin diameter and pole pin hole 50 has a pole pin hole diameter that is greater than the cross-pin diameter. Pole pin hole 50 has an inner cylindrical surface 58 and cross-pin 28 has an outer cylindrical surface 60. In the impact mode as shown in FIGS. 5 and 7 inner cylindrical surface 58 is spaced from outer cylindrical surface 60 and cross-pin axis 54 is generally aligned with pole pin hole axis 56 so that fastening cross-pin 28 is moved to a free position and a transverse annular void 62 is formed between cross-pin outer cylindrical surface 60 and pole pin hole inner cylindrical surface 58. In this manner, cross-pin 28 is moved to a free position wherein shearing pressure against fastening cross-pin 28 is avoided during the impact mode. In the static mode as shown in FIGS. 4 and 6, cross-pin axis 54 is generally axially spaced from pole pin hole axis 56 and the forward portions of cross-pin outer cylindrical surface 60 and pole pin hole inner cylindrical surface 58 have a contact area 64.

As seen in FIGS. 4 and 6 in the static mode, cross-pin axis 54 and pole pin hole axis 56 are in spaced parallel alignment. Because cross-pin 28 is connected to cap 22, cap cross-pin axis is positioned at constant longitudinal first distance $D_1$ from cap chamber interior face 40. Pole pin hole axis 56 in the static mode is positioned at a second distance $D_2$ from cap chamber interior face 40. First distance $D_1$ is greater than second distance $D_2$ by a distance $D_3$. Shock-absorbent biasable pad 32 occupies a longitudinal space between cap interior face 40 and pole planar front surface 46 measured by the distance $D_4$.

As seen in FIGS. 5 and 7 in the impact mode, cross-pin axis 54 and pole pin hole axis 56 are in general alignment at the distance $D_1$ measured to cap chamber interior face 40. Shock absorbent biasable pad 32 occupies a longitudinal space between cap interior 40 and pole planar front surface 46 measured by the distance $D_5$, which is less than the distance $D_4$ occupied by biasable pad 32 shown in FIGS. 4 and 6 in the static mode. The distance $D_5$ occupied by biasable pad 32 when added to the distance $D_3$ equals distance $D_4$. The distance $D_3$ between cross-pin axis 54 and pole pin hole axis 56 shown in FIG. 5 in the static mode is the same in the impact mode as shown in FIG. 5 as the reduced distance $D_3$ formerly occupied by biasable pad 32.

As shown in FIG. 3 and in FIGS. 6 and 7, cross-pin 28 includes a main pin portion 66, a threaded end 68 and an opposed pin locator end 70. Cap pin hole 52A is a threaded pin hole threadably secures that holds pin threaded end 68 and cap pin hole 52B is a locator pin hole that grips pin locator end 70 by a press fit. Locator pin hole 52B has a diameter less than the diameter of cross-pin 28 and pin locator end 70 has a pin locator end diameter generally the same as the diameter of locator pin hole 52B. A locator nose 71 extends from pin locator end 70. The main pin portion diameter is greater than the pin locator portion diameter wherein cross-pin 28 defines a cylindrical shoulder stop 72 between main pin portion 66 and pin locator end 70. Stop 72 is positioned at cap cylindrical side wall 36 and is configured to the interior cylindrical curvature of cap cylindrical side wall 36. Threaded end 68 can be rotated with a screw driver into screw recess 74 so that cross-pin 28 can be rotated inwardly until pin locator end 70 is press fitted into locator pin hole 52B so that cross-pin 28 fastens cap 22 to pole 14. Stop 72 prevents over-tightening of cross-pin 28 with pole 14.

Figure 8A:
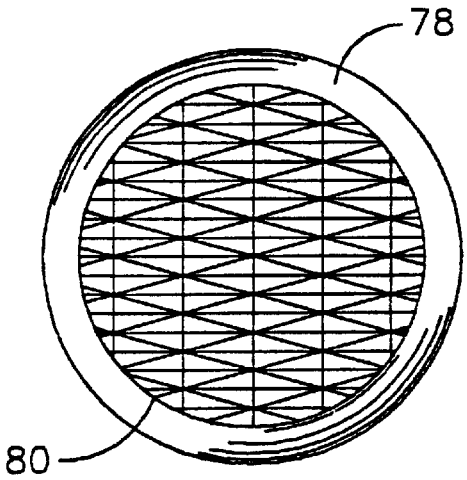
FIG. 8A is a front view of a cap in isolation having a knurled impact face.
Figure 8B:
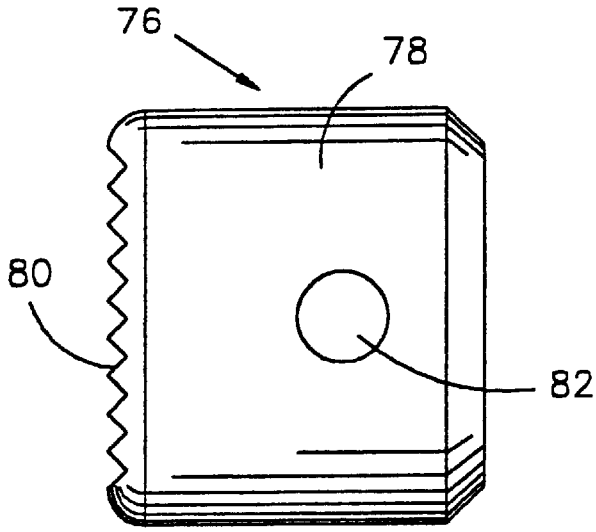
FIG. 8B is a side view of the cap shown in FIG. 8A.

FIGS. 8A and 8B show an alternate cap 76 that can be fitted over and secured to a hammer head such as hammer head 12. Alternate cap 76 includes a cylindrical cap side wall 78 and a transverse knurled face 80. A cap side wall threaded pinhole 82 in side wall 78 is shown devoid of a fastening pin.

Figure 9:
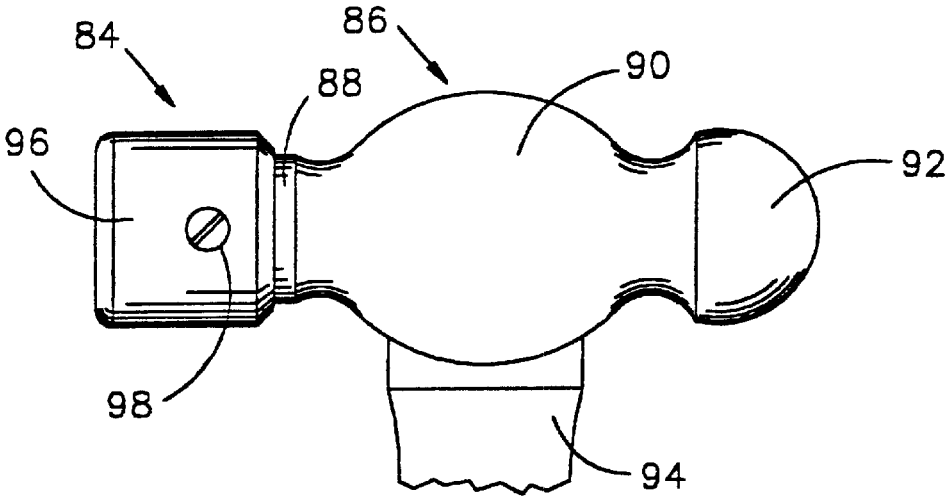
FIG. 9 is an elevational side view of an alternate inventive hammer having a ball pein rear region.

FIG. 9 is an elevational view of a hammer 84 having a hammer head 86 that includes a pole portion 88, a midportion 90, and a rear portion that comprises a ball pein 92. Hammer 84 includes a handle 94 attached to hammer head midportion 90. In accordance with the present invention, a cap 96, which is identical to cap 22 shown in FIGS. 1–8B is mounted to pole 88 and fastened to pole 88 by cross-pin 98 in a manner analogous to cross-pin 28 of FIGS. 1–7. In this manner, an alternate aspect of the invention is seen other than that of replacing a worn out cap, or replacing one type of cap with another type of cap onto a hammer head is shown in FIG. 9, in that a cap can be removed from one type of hammer head having one type of rear region, for example, a claw, and placed upon another type of hammer head having a different rear region, for example, ball pein 92.

Although the invention as thus far set forth has been described in some detail by way of illustration and example for purposes of clarity and understanding, it will, of course, be understood that various changes and modifications may be made in the form, details, and arrangements of the parts without departing from the scope of the invention. For example, the hammer head may have alternate configurations from the cylindrical pole and cap shown and discussed herein. That is, a rectangular pole and a rectangular cap can obviously be substituted for the cylindrical pole and cap. Many different types of striking faces for the cap can be used other than the substantially flat striking head with the adz eye and the knurled striking face shown and discussed. The material of the cap can vary, but generally it is a stainless steel. The cap not only is replaceable when worn out, but it can be made of a heavier metal than the hammer head, which can be, for example, made of a relatively light weight meal such as titanium that does not have the hardness and wearing capability of the steel cap.

Figure 10:
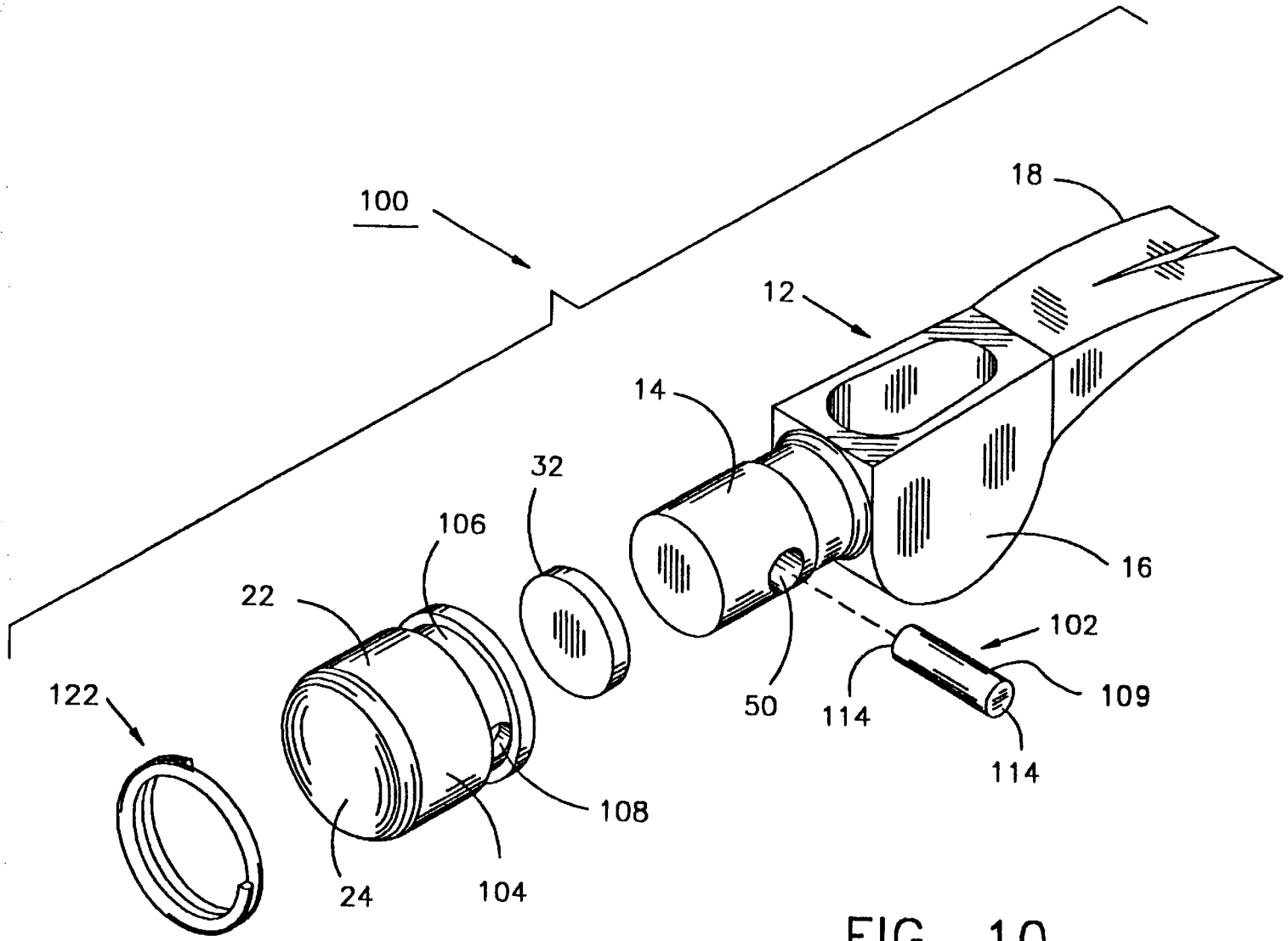
FIG. 10 is an exploded perspective view of another embodiment of a hammer with a claw rear region integral with the hammer center region and the hammer pole with the hammer cap and a cross-pin, hammer cap, and an external two-turn spiral retaining ring for keeping the cross-pin from lateral movement.
Figure 11:
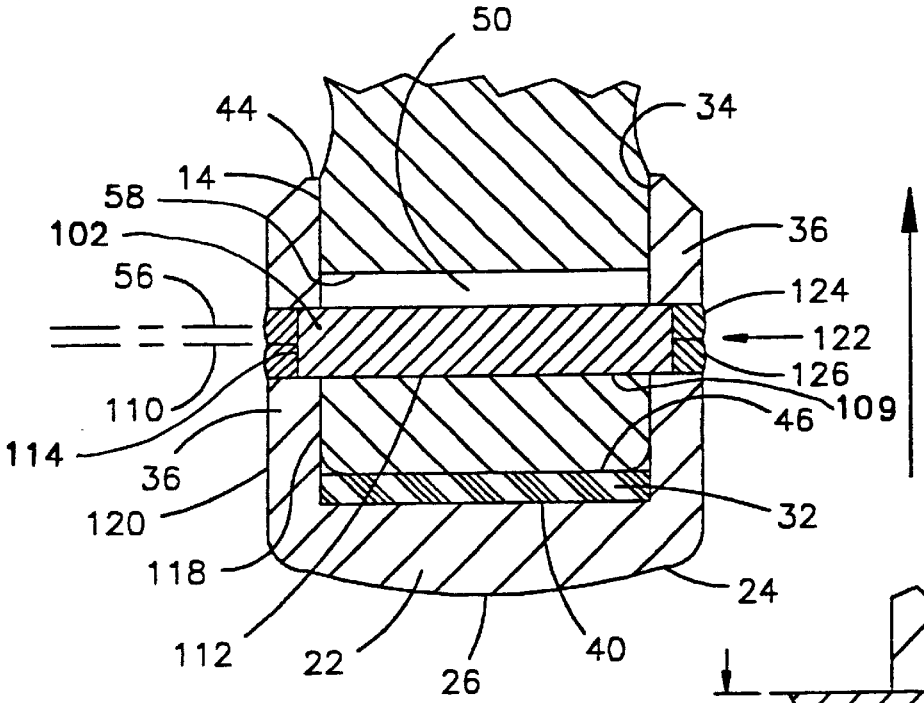
FIG. 11 is a partly sectioned top view of the hammer particularly showing the pole, cap, and fastening cross-pin mounted to the cap and also showing sectioned portions of the spiral retaining ring mounted in a groove around the cap at the ends of the cross-pin with the hammer being in the static mode analogous to FIG. 6.
Figure 12:
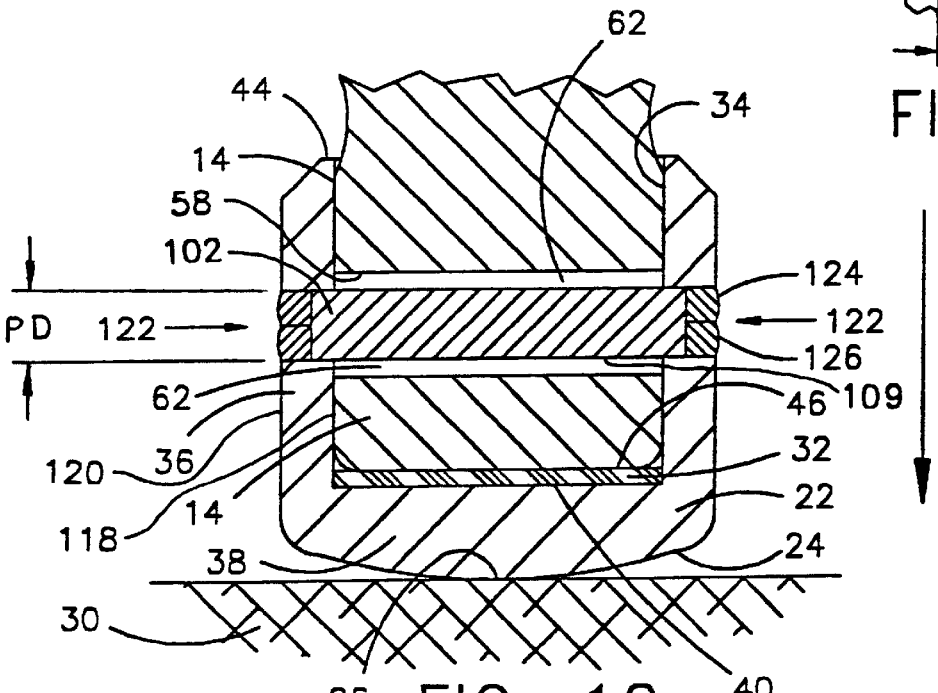
FIG. 12 is a partly sectioned top view of the hammer analogous to the view shown in FIG. 11 with the hammer shown in the impact mode.

Another embodiment of the invention as shown in FIGS. 10, 11, 12, 13, 14A and 14B is a hammer 100 that comprises hammer head 12 previously described in relation to FIGS. 1 and 2 that includes forward pole 14, mid-region 16, rear region claw 18. Mid-region 16 provides a socket for the handle (not shown). Hammer head 12 has a longitudinal dimension extending from pole 14 to claw 18. Hammer 100 further includes cylindrical cap 22 for hammer head 12 with cap 22 being removably fitted over cylindrical pole 14 with the axis of cylindrical cap 22 being axially aligned with the cylindrical axis of cylindrical pole 14. Cap 22 provides a selected type of cap impact face 24 for hammer head 12 so that cap 22 can be removed from hammer head 12 and in particular from pole 14 so that another type of cap can be placed over pole 14. The particular cap impact face 24 shown in FIGS. 10, 11, and 12 is of a type having a slight crown,or adz eye, 26, for purposes of exposition only, and in fact cap impact face 24 can be of a number of various types of striking faces known in the art.

In accordance with the inventive embodiment of hammer 100, as shown in FIGS. 10–12, cap 22 is removably secured to pole 14 by a fastening cylindrical cross-pin 102, which has the same diameter as cross-pin 28 previously described in relation to FIGS. 6 and 7. FIG. 11 shows pole 14 and cap 22 in a non-impact, or static, mode with cap impact face 24 remote from a workpiece 30 such as that shown in shown in FIG. 12. FIG. 12 shows pole 14 and cap 22 in an impact mode with cap impact face 24 in striking contact with workpiece 30. Cross-pin 102 allows pole 14 to move laterally relative to cap 22 in the longitudinal dimension between the impact mode position and the static mode position.

Shock-absorbing, biasable pad 32 both absorbs shock to hammer head 12 during the impact mode and also returns cap 22 by self-biasing action from the impact mode position shown in FIG. 12 to the static mode position shown in FIG. 11. Biasable pad 32 is positioned within cap 22 between cap impact face 24 and pole 14. Cap 22 forms a cap cylindrical chamber 34 defined by a longitudinally oriented cap cylindrical side wall 36 and a cap front wall 38 transverse to cap side wall 36. Cap front wall 38 includes cap external impact face 24 with adz eye 26 and an opposed cap planar interior chamber face 40 that is transverse to the axis of cylindrical cap 22. Cap chamber 34 has a circular aperture 42 opposed to cap interior chamber face 40. Circular aperture 42 is defined by the circular rim 44 of cap side wall 36.

Cylindrical pole 14 is slidably fitted to cap 22 within cap chamber 34 with the interior surface of cylindrical cap side wall 36 and is in mutual axially aligned sliding contact with the interior surface of cap cylindrical chamber 34 in the longitudinal direction. Pole 14 has a pole planar front surface 46 that is transverse to the axis of cylindrical pole 14 and that is spaced from cap planar chamber interior face 40. Biasable pad 32 is a disk, or cylindrical, in configuration that is axially aligned with pole 14 and cap 22. Biasable pad 32 is made of a resilient material such as rubber that is able to the absorb shock of the impact, or striking mode and thus reduces the shock to the hand and arm of the user. In addition, biasable pad 32 is forced into a biased mode when pole self-biasing capability to return to a non-biased mode so as to biasably force pole 14 away from cap chamber face 40 at the termination of the impact mode, that is, at the end of the striking blow of hammer head 12 against workpiece 30. The space between cap planar chamber face 40 and pole planar front surface 46 varies in response to pole 14 and cap 22 being in the static mode or the impact mode so that biasable pad 32 occupies a larger or a smaller space, respectively, therebetween. The action of pole 14 relative to cap 22 between the static mode and the impact mode is analogous to that of a piston in a cylinder block despite the smallness of the movement. The energy of the impact blow of hammer head 12 against workpiece 30 is partly absorbed by biasable pad 32 to enable biasable pad 32 to force pole 14 back into the static mode during the movement of biasable pad 32 from the biased mode to the unbiased mode. In the static mode of FIG. 11, pole planar front surface 46 is in contact with biasable pad 32 so as to maintain a slight compression against biasable pad 32 in the range of 0.002 inch to 0.007 inch.

In accordance with the invention of hammer 100, cap wall 104 defines a circumferential groove 106 as shown in FIGS. 10, 11, 12 and 15. Groove 106 is semi-circular in configuration. Pole 14 forms a cylindrical pole pin hole 50 as shown in FIGS. 6 and 7 transverse to the longitudinal, or pole axial, direction in general though not exact alignment with groove 106. Cap cylindrical side wall 36 forms a pair of opposed cap cylindrical pin holes 108 transverse to the pole axis and in general though not exact alignment with pole pin hole 50. Cap pin holes 108 each extends between grooves 106 and pole pin hole 50. Cap pin holes 108 are transverse to the longitudinal, or cap axial, direction of cap 22. Pole pin hole 50 has such dimension that accommodation is given relative to cylindrical cross-pin 102 to provide space for longitudinal movements of pole 14 within cap chamber 34, that is, pole pin hole 50 has a slightly greater diameter than cross-pin 102.

Fastening cross-pin 102 extends through pole pin hole 50 and is removably connected to cap 22 at cap pin holes 108. Cross-pin 102 has a cross-pin axis 110 and pole pin hole 50 has a pole pin hole axis 56. Cross-pin 102 has a cross-pin diameter and pole pin hole 50 has a pole pin hole diameter that is greater than the cross-pin diameter. Pole pin hole 50 has an inner cylindrical surface 58 and cross-pin 102 has a pin outer cylindrical surface 109. In the impact mode as shown in FIGS. 11 and 12, pole hole pin inner cylindrical surface 58 is spaced from pin outer cylindrical surface 109, and cross-pin axis 110 is generally aligned with pole pin hole axis 56 so that fastening cross-pin 102 is moved to a free position and a transverse annular void 62 is formed between cross-pin outer cylindrical surface 109 and pole pin hole inner cylindrical surface 58. In this manner, cross-pin 102 is moved to a free position wherein shearing pressure against fastening cross-pin 102 is avoided during the impact mode. In the static mode as shown in FIG. 11, cross-pin axis 110 is generally axially spaced from pole pin hole axis 56 and the forward portions of cross-pin outer cylindrical surface 109 and pole pin hole inner cylindrical surface 58 have a contact area 112.

As seen in FIG. 11 in the static mode, cross-pin axis 110 and pole pin hole axis 56 are in spaced parallel alignment. Because cross-pin 102 is connected to cap 22, cap cross-pin axis 110 is positioned at constant longitudinal first distance $D_1$ from cap chamber interior face 40. Pole pin hole axis 56 in the static mode is positioned at a second distance $D_2$ from cap chamber interior face 40. First distance $D_1$ is greater than second distance $D_2$ by a distance $D_3$. Shock-absorbent biasable pad 32 occupies a longitudinal space between cap interior face 40 and pole planar front surface 46 measured by the distance $D_4$.

As seen in FIG. 12 in the impact mode, cross-pin axis 110 and pole pin hole axis 56 are in general alignment at the distance $D_1$ measured to cap chamber interior face 40. Shock absorbent biasable pad 32 occupies a longitudinal space between cap interior 40 and pole planar front surface 46 measured by the distance $D_5$, which is less than the distance $D_4$ occupied by biasable pad 32 shown in FIG. 11 in the static mode. The distance $D_5$ occupied by biasable pad 32 when added to the distance $D_3$ equals distance $D_4$. The distance $D_3$ between cross-pin axis 110 and pole pin hole axis 56 shown in FIG. 11 in the static mode is the same in the impact mode as shown in FIG. 12 as the reduced distance $D_3$ formerly occupied by biasable pad 32.

Figure 13:
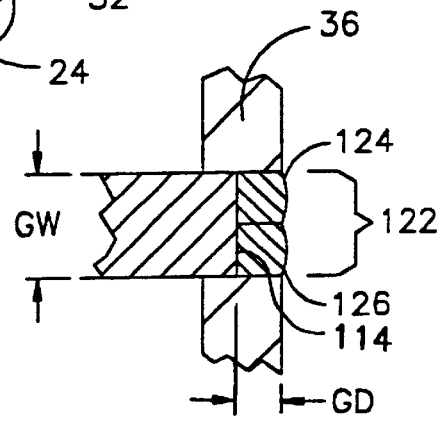
FIG. 13 is a broken sectioned view of the groove area of the cap.

As shown in FIGS. 10, 11 and 12, cross-pin 102 includes opposed cross-pin ends 114 that are positioned in cap pin holes 108. Groove 106 opens at both cap pin holes 108 as can be seen at typical groove opening 116 in FIG. 10. As seen in FIG. 13, groove 106 has a groove width GW and a groove diameter GD. As seen in FIGS. 11 and 12, cross-pin 102 has a pin diameter PD that is slightly less than groove width GW so that cross-pin 102 is slidably positioned in cap pin holes 108. Cylindrical cap 22 has cap cylindrical inner and outer surfaces 118 and 120, respectively. Cross-pin ends 114 are positioned between cap inner and outer surfaces 118 and 120 so that cross-pin ends 114 are at a distance from cap outer surface 120 that is equal to groove depth GD seen in FIG. 13.

Figure 14A:
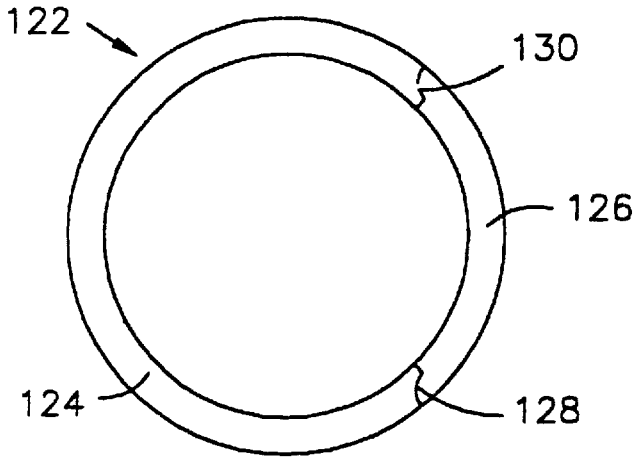
FIG. 14A is frontal view of the spiral retaining ring shown in FIGS. 11 and 12.
Figure 14B:
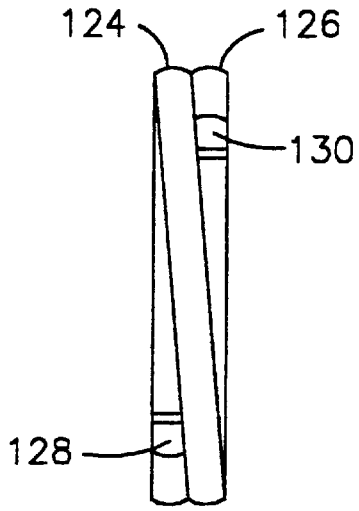
FIG. 14B is a side view of the spiral retaining ring shown in FIG. 14A.

An external retaining ring 122, shown in isolation in FIGS. 14A and 14B, is positioned in groove 106 and is in contact with cross-pin ends 114 so that retaining ring 122 externally holds cross-pin 102 in mounted relationship with cap 22. Retaining ring 122 is also shown in FIG. 10. Retaining ring 122 is a spiral retaining ring having a 360 degree retaining surface. Retaining ring 122 as shown in FIGS. 14A and 14B is a 2-turn spiral ring with an offset configuration and is preferably made of carbon and stainless steel with a self-biasing capability. Retaining ring 122 can alternatively have other configurations such as those shown in the catalogue of Smalley Steel Ring Company, Wheeling, Ill. Groove depth GD can be deep so as to accommodate a heavy duty type of retaining ring 122 that may be necessary for certain tasks.

Figure 16:
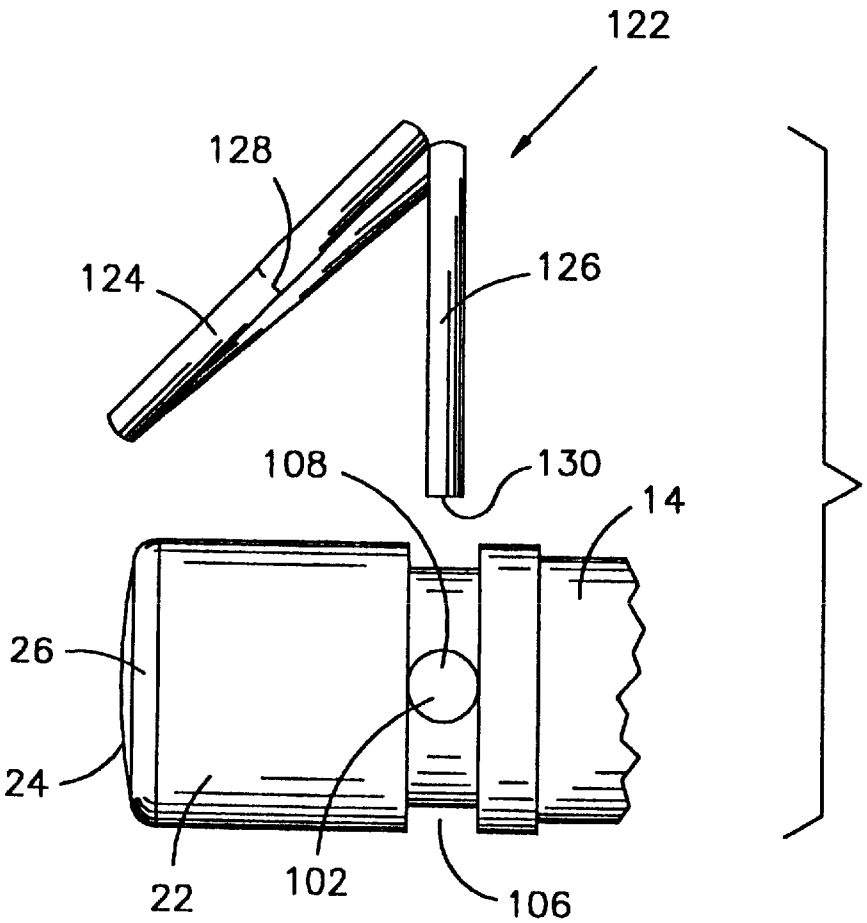
FIG. 16 is a broken side view of the cap and pole of the hammer with one coil of the spiral retaining ring having been separated and about to be wound into the groove of the cap.

Retaining ring 122 is shown in FIG. 16 being mounted into groove 106. Retaining ring 122 includes opposed first and second coils 124 and 126 having free ends 128 and 130, respectively. First coil 124 is shown having been separated from second coil 126 thus enabling its free end 132 to be inserted into groove 106. Retaining ring 122 is thereupon rotated, or wound, into groove 106 until both coils 126 and 128 have been fully seated in groove 106 thus in contact with cross-pin ends 114 so as to hold cross-pin 102 in position.

FIG. 16 indicates the manual method of how to mount retaining ring 122 into groove 106. One coil 124 has been separated from coil 126 and free end 128 is being positioned for placement into groove 106 at which position coil 124 will be wound into groove 106 followed by coil 126 until retaining ring 122 is fully seated in groove 106. Upon retaining ring 126 being seated in groove 106, cross-pin 102 is fully secured in a locking relationship with cap 22.

Retaining ring 122 can be removed from groove 106 by prying either coil end 128 or 130 with an instrument out of its seating in groove 106 so that the associated coil can be unwound from groove 106 along with the entire retaining ring 122 so as to free cross-pin 102 for removal from it locking relationship with cap 22 and pole 14 and cross-pin 102 can be freely slid from cap 22 so as to allow cap 22 to be removed from pole 14 and biasable pad 32 can be removed from cap chamber 34 and a new pad 34 be inserted therein and cap 22 and pole 14 be reassembled with cross-pin 102 inserted into cap pin holes 108 and pole pin hole 50 and retaining ring 122 be again remounted in groove 106.

Figure 15A:
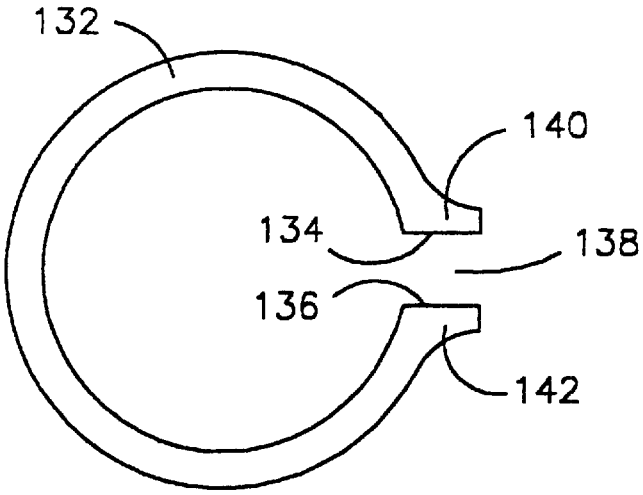
FIG. 15A is a frontal view of an alternative snap-type retaining ring.
Figure 15B:
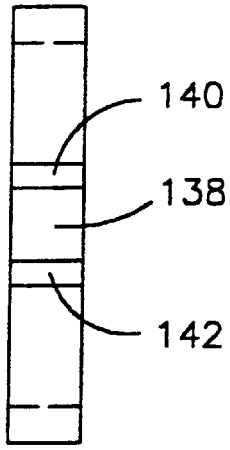
FIG. 15B is a side view of the retaining ring shown in FIG. 15A.

A snap retaining ring 132 shown in FIGS. 15A and 15B is another embodiment of an external retaining ring that can be seated into groove 106. Snap retaining ring 132 is basically circular with opposed free ends 134 and 136 that define a ring gap 138. Ears 140 and 142 extend outwardly from free ends 134 and 136, respectively. Snap retaining ring 132 is biasable between a closed mode as shown in FIGS. 15A and 15B and an open mode (not shown). To place snap retaining ring 132 in the open mode, a user holds ears 140 and 142 and pulls ends 134 and 136 apart into the biased open mode at which time snap retaining ring 132 can be seated in groove 106 and then ears 140 and 142 released so that snap retaining ring 132 self-biases into its non-biased mode and is locked into a fully retaining position so as to secure cross-pin 102 in its fastening relationship with cap 22 and pole 14. Snap retaining ring 132 is removed from groove 106 by the user holding ears 140 and 142 and pulling them apart to as to move snap retaining ring 132 into its biased mode so as to allow the user to remove retaining ring 132 from groove 106 so that cross-pin can be freely slid from cap 22. Cross-pin 102 is then freed for removal from it locking relationship with cap 22 and pole 14 and can be freely slid from cap 22 so as to allow cap 22 to be removed from pole 14 and biasable pad 32 can be removed from cap chamber 34 and a new pad 34 be inserted therein. Cap 22 and pole 14 is then reassembled and cross-pin 102 inserted into cap pin holes 108 and pole pin hole 50 and a new retaining ring 132 is then remounted in groove 106.

Figure 17:
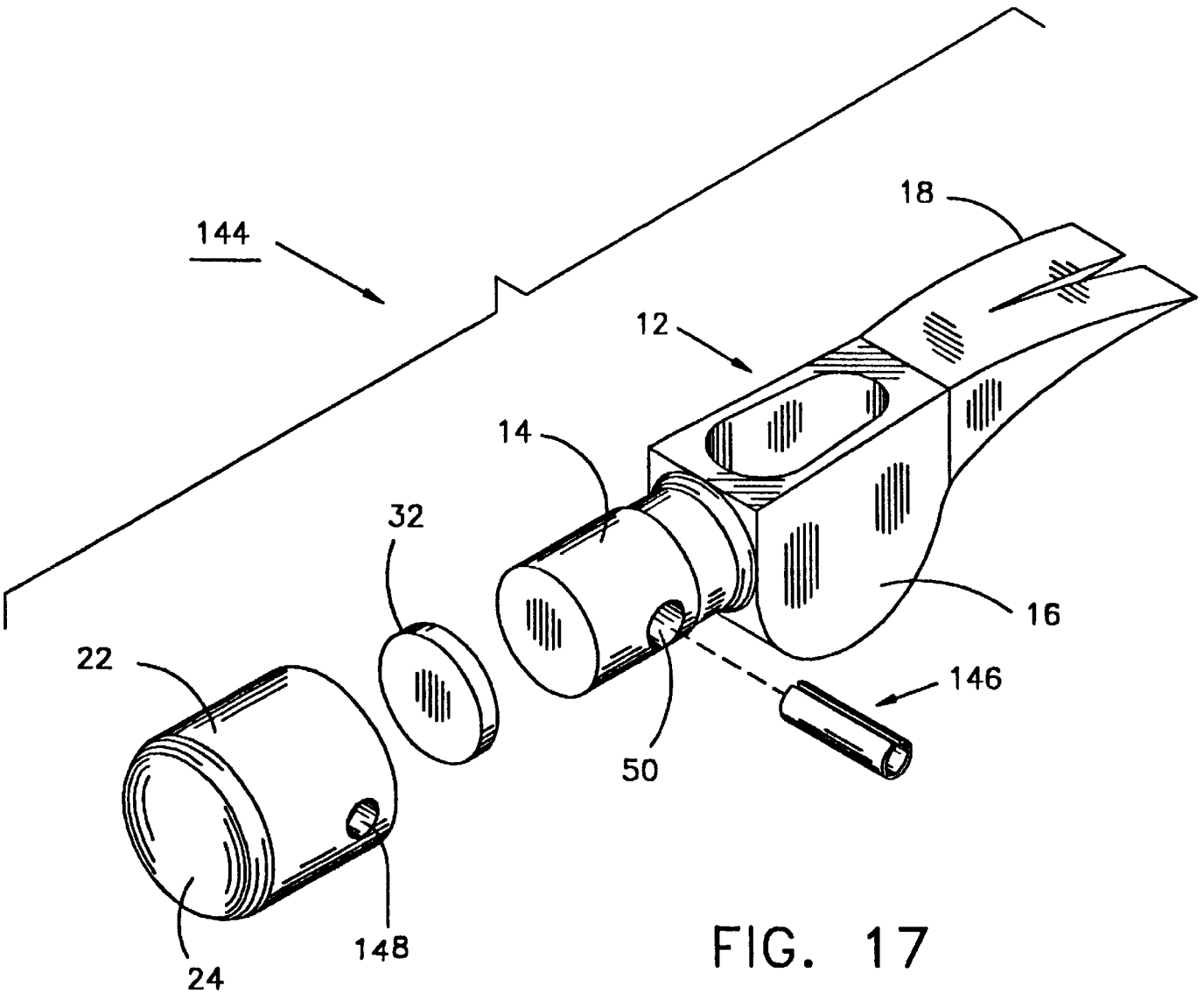
FIG. 17 is an exploded perspective view of another embodiment of a hammer the hammer cap and a biasable expansion-type cross-pin that holds the pole to the cap.

Another embodiment of the invention is shown in FIG. 17 as a hammer 144 that comprises hammer head 12 previously described in relation to FIGS. 1 and 2 that includes forward pole 14, mid-region 16, rear region claw 18. Mid-region 16 provides a socket for the handle (not shown). Hammer head 12 has a longitudinal dimension extending from pole 14 to claw 18. Hammer 144 fuirther includes cylindrical cap 22 for hammer head 12 with cap 22 being removably fitted over cylindrical pole 14 with the axis of cylindrical cap 22 being axially aligned with the cylindrical axis of cylindrical pole 14. Cap 22 provides a selected type of cap impact face 24 for hammer head 12 so that cap 22 can be removed from hammer head 12 and in particular from pole 14 so that another type of cap can be placed over pole 14. The particular cap impact face 24 shown in FIGS. 17, 18, and 19 is of a type having a slight crown, or adz eye, 26, for purposes of exposition only, and in fact cap impact face 24 can be of a number of various types of striking faces known in the art.

Figure 18:
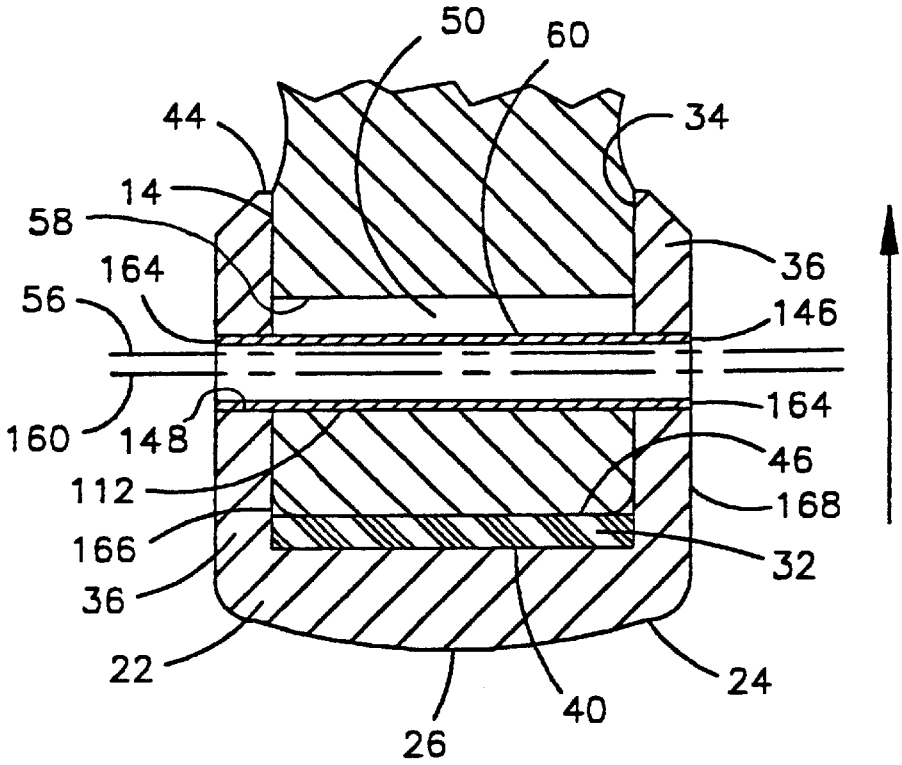
FIG. 18 is a partly sectioned top view of the pole, cap, and fastening cross-pin mounted to the cap and also showing sectioned portions of the biasable expansion retaining cross-pin mounted in a groove around the cap at the ends of the cross-pin with the hammer being in the static mode analogous to FIG. 6.

In accordance with the inventive embodiment of hammer 144 and as shown in added detail in FIGS. 18, 19, 20A and 20B, cap 22 is removably secured to pole 14 by a fastening cylindrical cross-pin 146, which has the same diameter as cross-pin 28 described in relation to FIGS. 6 and 7 and to cross-pin 102 described in relation to FIGS. 11 and 12. FIG. 18 shows pole 14 and cap 22 in a non-impact, or static, mode with cap impact face 24 remote from a workpiece 30 such as that shown in shown in FIG. 19, which shows pole 14 and cap 22 in an impact mode with cap impact face 24 in striking contact with workpiece 30. Cross-pin 146 allows pole 14 to move laterally relative to cap 22 in the longitudinal dimension between the impact mode position and the static mode position.

Figure 19:
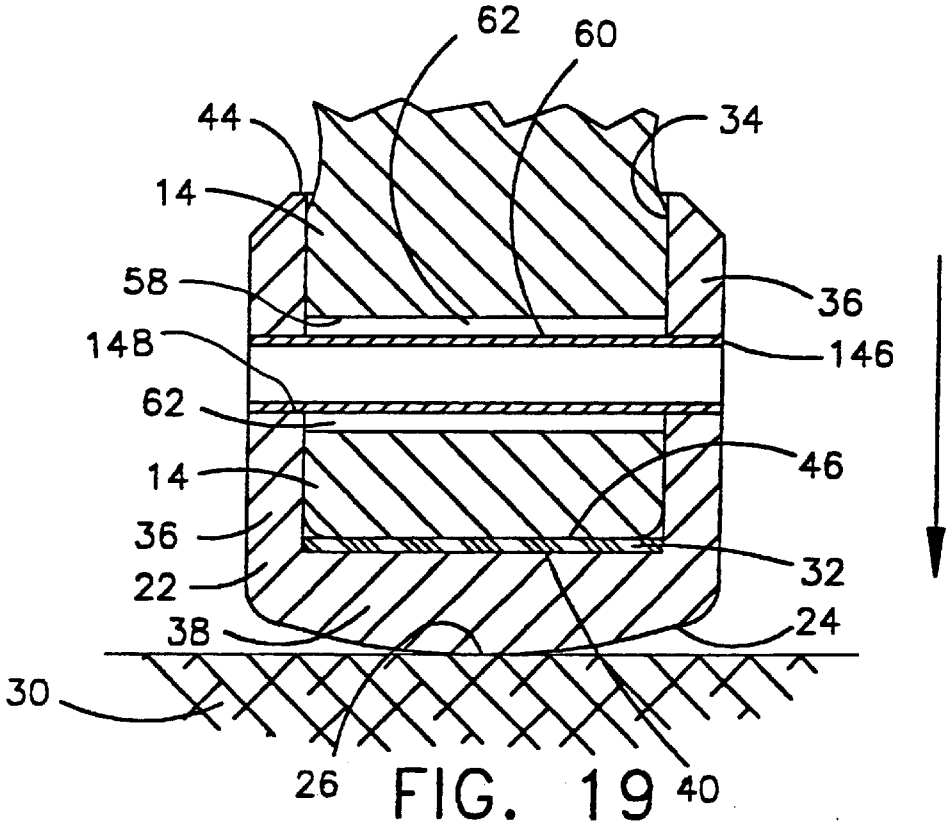
FIG. 19 is a partly sectioned top view analogous to the view shown in FIG. 18 with the hammer shown in the impact mode.

Shock-absorbing, biasable pad 32 both absorbs shock to hammer head 12 during the impact mode and also returns cap 22 by self-biasing action from the impact mode position shown in FIG. 19 to the static mode position shown in FIG. 18. Biasable pad 32 is positioned within cap 22 between cap impact face 24 and pole 14. Cap 22 forms a cap cylindrical chamber 34 defined by a longitudinally oriented cap cylindrical side wall 36 and a cap front wall 38 transverse to cap side wall 36. Cap front wall 38 includes cap external impact face 24 with adz eye 26 and an opposed cap planar interior chamber face 40 that is transverse to the axis of cylindrical cap 22. Cap chamber 34 has a circular aperture 42 opposed to cap interior chamber face 40. Circular aperture 42 is defined by the circular rim 44 of cap side wall 36.

Cylindrical pole 14 is slidably fitted to cap 22 within cap chamber 34 with the interior surface of cylindrical cap side wall 36 and is in mutual axially aligned sliding contact with the interior surface of cap cylindrical chamber 34 in the longitudinal direction. Pole 14 has a pole planar front surface 46 that is transverse to the axis of cylindrical pole 14 and that is spaced from cap planar chamber interior face 40. Biasable pad 32 is a disk, or cylindrical, in configuration that is axially aligned with pole 14 and cap 22. Biasable pad 32 is made of a resilient material such as rubber that is able to the absorb shock of the impact, or striking mode and thus reduces the shock to the hand and arm of the user. In addition, biasable pad 32 is forced into a biased mode when pole self-biasing capability to return to a non-biased mode so as to biasably force pole 14 away from cap chamber face 40 at the termination of the impact mode, that is, at the end of the striking blow of hammer head 12 against workpiece 30. The space between cap planar chamber face 40 and pole planar front surface 46 varies in response to pole 14 and cap 22 being in the static mode or the impact mode so that biasable pad 32 occupies a larger or a smaller space, respectively, therebetween. The action of pole 14 relative to cap 22 between the static mode and the impact mode is analogous to that of a piston in a cylinder block despite the smallness of the movement. The energy of the impact blow of hammer head 12 against workpiece 30 is partly absorbed by biasable pad 32 to enable biasable pad 32 to force pole 14 back into the static mode during the movement of biasable pad 32 from the biased mode to the unbiased mode. In the static mode of FIG. 18, pole planar front surface 46 is in contact with biasable pad 32 so as to maintain a slight compression against biasable pad 32 in the range of 0.002 inch to 0.007 inch.

In accordance with the inventive embodiment of hammer 144, pole 14 forms a cylindrical pole pin hole 50 as previously described in relation to FIGS. 5 and 6 and FIGS. 11 and 12. Pole pin hole 50 is transverse to the longitudinal, or pole axial, direction. Cap cylindrical side wall 36 forms a pair of opposed cap cylindrical pin holes 148 transverse to the pole longitudinal axis and in general though not exact alignment with pole pin hole 50. Cap pin holes 148 are transverse to the longitudinal, or cap axial, direction of cap 22. Pole pin hole 50 has such dimension that accommodation is given relative to cylindrical cross-pin 146 to provide space for longitudinal movements of pole 14 within cap chamber 34, that is, pole pin hole 50 has a slightly greater diameter than cross-pin 146.

Fastening cross-pin 146 extends through pole pin hole 50 and is removably connected to cap 22 at cap pin holes 148. Cross-pin 148 has a cross-pin axis 150 and pole pin hole 50 has a pole pin hole axis 56. Cross-pin 146 has a cross-pin cylindrical, or annular, wall 152 having a cross-pin wall inner annular surface 154 and a cross-pin wall outer cylindrical surface 156. Cross-pin cylindrical wall 152 defines a cross-pin cylindrical cavity 158. Cross-pin outer cylindrical surface 156 defines the outer diameter of cross-pin 146. Pole pin hole 50 has a pole pin hole diameter that is greater than the diameter of cross-pin wall outer cylindrical surface 156.

In the impact mode as shown in FIG. 19, cross-pin axis 160 is generally aligned with pole pin hole axis 56 so that fastening cross-pin 146 is moved to a free position and a transverse annular void 62 is formed between cross-pin outer cylindrical surface 156 and pole pin hole inner cylindrical surface 58. In this manner, cross-pin 146 is moved to a free position wherein shearing pressure against fastening cross-pin 146 is avoided during the impact mode. In the static mode as shown in FIG. 18, cross-pin axis 156 is generally axially spaced from pole pin hole axis 56 and the forward portions of cross-pin outer cylindrical surface 154. In the static mode as shown in FIG. 18, cross-pin axis 160 is generally axially spaced from pole pin hole axis 56 and the forward portions of cross-pin outer cylindrical surface 156 and pole pin hole inner cylindrical surface 58 have a contact area 64.

As seen in FIG. 18 in the static mode, cross-pin axis 160 and pole pin hole axis 56 are in spaced parallel alignment. Because cross-pin 146 is connected to cap 22, cross-pin axis 160 is positioned at constant longitudinal first distance $D_1$ from cap chamber interior face 40. Pole pin hole axis 56 in the static mode is positioned at a second distance $D_2$ from cap chamber interior face 40. First distance $D_1$ is greater than second distance $D_2$ by a distance $D_3$. Shock-absorbent biasable pad 32 occupies a longitudinal space between cap interior face 40 and pole planar front surface 46 measured by the distance $D_4$.

As seen in FIG. 19 in the impact mode, cross-pin axis 160 and pole pin hole axis 56 are in general alignment at the distance $D_1$ measured to cap chamber interior face 40. Shock absorbent biasable pad 32 occupies a longitudinal space between cap interior 40 and pole planar front surface 46 measured by the distance $D_5$, which is less than the distance $D_4$ occupied by biasable pad 32 shown in FIG. 18 in the static mode. The distance $D_5$ occupied by biasable pad 32 when added to the distance $D_3$ equals distance $D_4$. The distance $D_3$ between cross-pin axis 160 and pole pin hole axis 56 shown in FIG. 18 in the static mode is the same in the impact mode as shown in FIG. 19 as the reduced distance $D_3$ formerly occupied by biasable pad 32.

As shown in FIGS. 18 and 19, cross-pin 146 includes opposed cross-pin ends 164 that are positioned in cap pin holes 148. Cylindrical cap 22 has cap cylindrical inner and outer surfaces 166 and 168, respectively. Cross-pin ends 164 are positioned between cap inner and outer cylindrical surfaces 166 and 166.

Figure 20A:
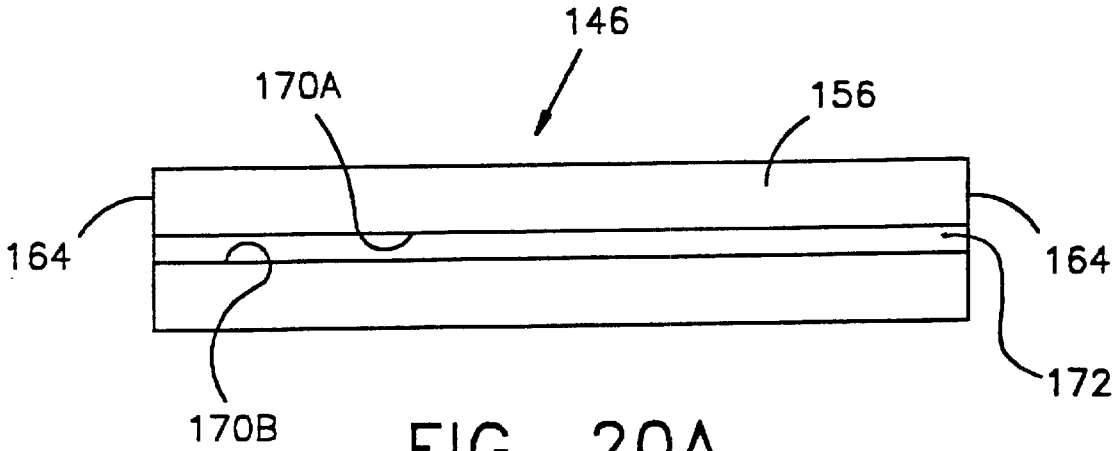
FIG. 20A is a frontal view of the biasable expansion retaining cross-pin shown in FIGS. 17–19.
Figure 20B:
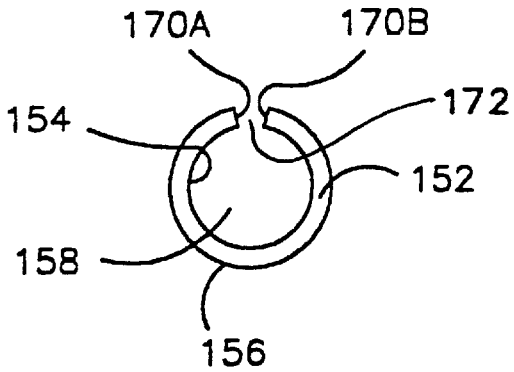
FIG. 20B is a side view of the biasable expansion retaining cross-pin shown in FIG. 20A.

Cross-pin 146 is configured as an expansion retaining pin that is in biased holding relationship with cap 22 at opposed cap pin holes 148. Thus, cross-pin 146 has a double function as a cross-pin 146 for mounting pole 14 with cap 22 and as a self-biased expansion retaining pin. As best seen in FIGS. 20A and 20B, cross-pin cylindrical wall 152 further has opposed linear side walls 170A and 170B extending lengthwise relative to cross-pin 146 between cross-pin/expansion-pin ends 164 and define therebetween a linear gap, or slot, 172 that likewise extends between cross-pin/expansion-pin ends 164. Cross-pin/expansion pin is 154 is biasably movable between first and second modes as follows: the first mode is wherein cylindrical cross-pin 146 and particularly cross-pin wall 152 is in an unbiased mode wherein linear slot 172 is defined by a first distance between linear side walls 170A and 170B. The second mode is wherein cross-pin wall 152 is in a biased mode wherein linear slot 172 is defined by a second distance between linear side walls 170A and 170B that is less than the first distance. Cross-pin/expansion pin 146 is positioned in opposed cap pin holes 148 in the biased second mode wherein cylindrical cross-pin wall is biasably pressed against cap 22 at said cap pin holes 148 so as to biasably grip cap 22 and thus hold cross-pin 146 to cap 22. Cross-pin/expansion pin 146 is removable from cap pin holes 142 while in the biased second mode by forced lateral movement relative to cap pin holes 142 at which time cross-pin/expansion pin 146 self-biases to the first unbiased mode. Cross-pin/expansion pin 146 is preferably made of a biasable metal such as steel but can be made of any biasable material that is capable of withstanding shock and hard usage.

Cross-pin/expansion pin 146 can be mounted into cap pin holes 148 by using a pressing tool to force cross-pin/expansion pin 146 from the unbiased mode to the biased mode sufficient to reduce the outer diameter of cross-pin/expansion pin 146 to a dimension that is slightly less than the diameter of cap pin holes 148 and thereupon by using a knocking tool to force cross-pin/expansion pin 146 into cap pin holes 148 at which time cross-pin/expansion pin 146 self-biases into the biased second mode against the inner cylindrical surface 154 of cap pin holes 148 wherein cap 22 is locked with pole 14. A tool is used to knock cross-pin/expansion pin 146 from cap pin holes 148. At such time, a worn biasable pad 32 can be removed from cap chamber 34 and replaced by a new biasable pad 32. Cross-pin/expansion pin 146 can then be mounted to cap 22 and pole 14 in the manner described above.

Although the invention as related to FIGS. 10–20B thus far set forth has been described in some detail by way of illustration and example for purposes of clarity and understanding, it will, of course, be understood that various changes and modifications may be made in the form, details, and arrangements of the parts without departing from the scope of the invention. For example, external retaining ring 122 can have various configurations including the number or coils and the type of material can be other than steel but can be of any material with the strength to withstand shock and usage.

What is claimed is:

1. A hammer including a handle, comprising:

a hammer head having a longitudinal dimension including a poll, a cap slidably fitted over said poll, fastening means for removably securing said cap to said poll and for allowing said poll to move relative to said cap in the longitudinal dimension between an impact mode position of said cap against a work object and a static mode position of said cap remote from the work object, a biasable pad positioned within said cap, between said cap and said poll, said fastening means fturther including said poll having a pin hole transverse to the longitudinal dimension and said cap having a side wall having a pair of opposed cap pin holes in general alignment with said poll pin hole, said fastening means further including a cross-pin extending through said poll pin hole and removably mounted to said cap at said pair of cap pin holes.

2. A hammer in accordance with claim 1, wherein said cross-pin has opposed pin ends, said cap having a cap external side wall surface and a cap internal side wall surface, each of said opposed pin ends being positioned between said internal and external side wall surfaces.

3. The hammer in accordance with claim 2, wherein said cross-pin has a cross-section area parallel to the cross-pin opposed ends and being smaller than a cross-sectional area of said poll pin hole.

4. The hammer in accordance with claim 2, wherein the cross-pin is an expansion pin.

5. The hammer in accordance with claim 2, wherein the fastening means further comprises an external retaining ring positioned in a groove in the cap external side wall surface.

6. The hammer in accordance with claim 5, wherein said external retaining ring is a biasable external retaining ring.

7. The hammer in accordance with claim 6, wherein said biasable external retaining ring is a biasable spiral retaining ring having a 360 degree retaining surface.

8. The hammer in accordance with claim 7, wherein said spiral retaining ring includes a plurality of coils.

9. The hammer in accordance with claim 5, wherein said external retaining ring is a snap retaining ring including opposed ring ends defining a gap therebetween.

10. The hammer in accordance with claim 9, wherein said snap retaining ring includes a pair of gripping ears connected to said opposed ring ends.

11. The hammer in accordance with claim 5, wherein said external retaining ring is made carbon steel.

12. The hammer in accordance with claim 5, wherein said external retaining ring is made of stainless steel.

13. A hammer including a handle, comprising:

a hammer head having a longitudinal dimension including a poll, cap means having a cap impact face and being removably and slidingly fitted to said poll, fastening means for removably securing said cap means to said poll and for allowing said poll to move relative to said cap means in the longitudinal dimension between an impact mode position of said cap impact face against a work object and a static mode position of said cap impact face remote from the work object, biasable pad means for absorbing shock to said hammer head during the impact mode and for self-biasably returning said poll from the impact mode position to the static mode position, said biasable pad being positioned between said cap means and said poll, said fastening means further comprising said poll having a poll pin hole transverse to the longitudinal dimension and said cap side wall having a pair of opposed cap pin holes in general alignment with said poll pin hole, said fastening means further comprising a cross-pin extending through said poll pin hole and removably mounted to said cap at said pair of cap pin holes.

14. The hammer in accordance with claim 13, wherein said cross-pin further comprises an expansion pin.

15. The hammer in accordance with claim 14, wherein said expansion pin has opposed expansion pin ends positioned in said opposed cap pin holes, said cap having an external cap side wall surface and an internal cap side wall surface, said expansion pin having opposed expansion pin ends positioned between said internal and external cap side wall surfaces.

16. The hammer in accordance with claim 15, wherein said expansion pin further comprises an annular wall defining a cylindrical cavity, said annular wall having a slot extending between said expansion pin ends.

17. The hammer in accordance with claim 14, wherein said expansion pin is made of stainless steel.

18. The hammer in accordance with claim 14, wherein said expansion pin is made of carbon steel.

19. A hammer comprising:

a handle;

a head connected to said handle;

a cap slidably connected to said head;

a pin adapted to connect said cap to said head and to permit slidable movement of said cap relative to said head; and a resilient pad disposed between said head and said cap.

20. A hammer in accordance with claim 19, wherein said cap defines a cavity therein, and a porton of said head is slidably received within said cavity.

21. A hammer in accordance with claim 19, wherein said pad is replaceable.

22. A hammer in accordance with claim 19, wherein said fastener further comprises an expansion pin.

23. A hammer in accordance with claim 19, wherein said pin is rem ovably connected to said cap.

24. A hammer in accordance with claim 19, wherein said head has a longitudinal dimension and an aperture therethrough, said aperture being arranged perpendicular to said longitudinal dimension.

25. A hammer in accordance with claim 24, wherein said pin has a cross-section and said aperture has a cross-section that is larger than said cross-section of said pin.

26. A hammer in accordance with claim 25, wherein said pin is connect ed to said cap and arranged to have a portion of said pin disposed n said aperture.

27. A hammer in accordance with claim 19, wherein said pad remains in contact with said cap and said head.

28. A hammer in accordance with claim 27, wherein said aperture has a forward surface and wherein in a static mode said pin contacts said forward surface of said aperture and said cap and head are in contact with said pad.

29. A hammer in accordance with claim 28, wherein when said hammer is used to strike an object with said cap, said pin is moved rearward within said aperture and said pad is compressed.

30. A hammer in accordance with claim 29, wherein in said static mode said pad is held under slight compression between said cap and said head.

31. A hammer in accordance with claim 30, wherein when said hammer is used to strike an object with said cap, said pin is moved rearward within said aperture and said pad is further compressed.

32. A hammer in accordance with claim 19, wherein said head and said cap are made of different materials.

* * * * *

UNITED STATES PATENT AND TRADEMARK OFFICE

CERTIFICATE OF CORRECTION

PATENT NO. : 6,457,384 B1
DATED : October 1, 2002
INVENTOR(S) : Cox et al.

It is certified that error appears in the above-identified patent and that said Letters Patent is hereby corrected as shown below:

Column 14,
Line 55, change “fturther” to read -- further --.

Column 15,
Line 24, -- of -- should be inserted after “is made”.

Column 16,
Line 27, change “rem ovably” to read -- removably --.
Line 37, change “connect ed” to -- read -- connected --.
Line 38, after “disposed” -- in -- should be substituted for “n”.

Signed and Sealed this

Seventh Day of January, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,457,384 B1
DATED : October 1, 2002
INVENTOR(S) : Cox et al.

It is certified that error appears in the above-identified patent and that said Letters Patent is hereby corrected as shown below:

Delete title page and substitute the attached title page.

Delete the specification Columns 1-16 and substitute the attached Columns 1-16.

This certificate supersedes Certificate of Correction issued January 7, 2003.

Signed and Sealed this

Thirtieth Day of May, 2006

JON W. DUDAS
*Director of the United States Patent and Trademark Office*

(12) United States Patent
Cox et al.

(10) Patent No.: US 6,457,384 B1
(45) **Date of Patent: *Oct. 1, 2002**

(54) CAPPED HEAD HAMMER

(75) Inventors: Michael L. Cox, Lewistown, IL (US); Ted Jerominski, Woodstock, IL (US)

(73) Assignee: Vaughan & Bushnell Manufacturing Company, Hebron, IL (US)

( * ) Notice: Subject to any disclaimer, the term of this patent is extended or adjusted under 35 U.S.C. 154(b) by 72 days.

This patent is subject to a terminal disclaimer.

(21) Appl. No.: 09/708,206

(22) Filed: Nov. 8, 2000

Related U.S. Application Data

(63) Continuation-in-part of application No. 09/512,398, filed on Feb. 24, 2000.

(51) Int. Cl.[7] ..... B25D 1/00
(52) U.S. Cl. ..... 81/22; 81/25
(58) Field of Search ..... 81/20, 21, 22, 25

(56) References Cited

U.S. PATENT DOCUMENTS

| | | | | | |
|---|---|---|---|---|---|
| 1,045,145 | A | * | 11/1912 | Hubbard | 81/22 |
| 1,732,985 | A | * | 10/1929 | Peters | 81/22 |
| 1,781,344 | A | * | 11/1930 | Salazar | 81/22 |
| 1,792,153 | A | * | 2/1931 | Evich | 81/25 |
| 2,198,764 | A | * | 4/1940 | Edwards | 81/22 |
| 2,491,295 | A | * | 12/1949 | Anderson | 81/25 |
| 2,952,284 | A | * | 9/1960 | Nichols et al. | 81/19 |
| 3,148,716 | A | * | 9/1964 | Vaughan, Jr. | 81/22 |

* cited by examiner

*Primary Examiner*—Eileen P. Morgan
*Assistant Examiner*—Joni B. Danganan
(74) *Attorney, Agent, or Firm*—David M. Thimmig; Mayer, Brown, Rowe & Maw

(57) ABSTRACT

A hammer having a hammer head and a cap removably slidably fitted to the hammer head. A biasable pad for absorbing shock is positioned between the cap and the hammer head. A cross-pin connects the cap and hammer head while permitting slidable movement therebetween.

32 Claims, 11 Drawing Sheets

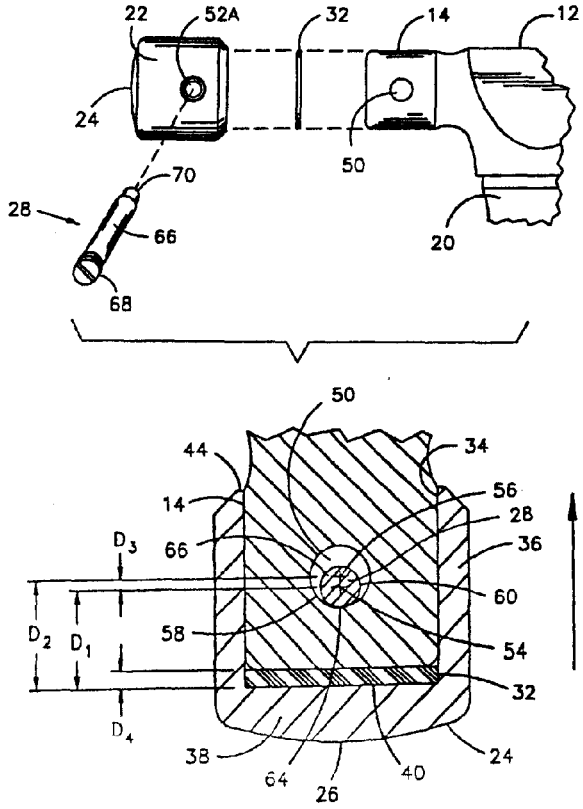

CAPPED HEAD HAMMER

RELATED APPLICATION

The present invention is a continuation-in-part application of U.S. patent application Ser. No. 09/512,398, filed on Feb. 24, 2000.

FIELD OF THE INVENTION

The present invention relates to the field of hammers and more particularly to the field of replaceable caps for hammers.

DESCRIPTION OF THE PRIOR ART

The striking face of a hammer is often subjected to forces that require extra toughness and hardness. Because of the heavy duty usage of certain hammers, the impact faces wear out more rapidly than normal hammers. One example of this type of hammer is the framing hammer, used in the art of house building. Such types of hammer are heavier than the average hammer, and in order to eliminate the cost of manufacturing an entire hammer that includes a unitary head that meets the toughness required, it is known in the art to attach a separate hammer head portion, or capped head, or cap, at the end area, or poll, of the hammer head. Such caps, which are often made of a strong but heavy metal such as stainless steel, are known in the art.

Hammers have various types of striking faces, for example, flat faces and knurled faces. In addition, hammers having heavy duty striking faces often require different versions of the rear region of the hammer head, for example, a claw and a ball peen. A replaceable cap having a tough striking face thus has another application.

In another area of the art of hammers, shock absorbing structures that reduce shock to the hands and arms of users during impact are known. Combining such shock absorbing structures with a replaceable cap is also known.

Patents relating to the art of hammers that disclose various aspects of capped heads are as follows:

1) Patents that disclose detachable, or replaceable, head caps combined with shock-absorbing cushions or washers known in the art of hammers are as follows:

U.S. Pat. No. 2,518,059 issued to M. Permerl on Aug. 8, 1950, discloses a mallet having interchangeable percussion heads 14 and 17 removably screwed to a mallet head 10. Interposed between the inner end face of percussion members 14 and 17 are washers 16 and 23, respectively, which are made of a resilient material such as rubber.

U.S. Pat. No. 3,000,414 issued to N. Cordis on Sep. 19, 1961, discloses a hammer 10 having a hammer head 12 and a replaceable, or "floating", striking head 15 provided with an elongated stud 16 that is accommodated by a bore 17 in hammer head 12. A flexible, resilient sleeve 20 connects floating head 15 to hammer head 12. FIGS. 2–5 show a resilient sleeve 29 that includes a supplemental integral cap 23 providing a rim 24 about striking head 15. Sleeve 20 is capable of withstanding the impact and the constant flexing in its cushioning action. Sleeve 20 also grips the snub-nose tip 14 of hammer head 12 and holds striking head 15 in an alternative embodiment as shown in FIGS. 2–5.

2) A patent disclosing a removable and replaceable capped head is as follows:

U.S. Pat. No. 2,515,431 issued to C. A. Ulfves on Jul. 18, 1950, discloses a unitary detachable hammer tip set forth in FIG. 2 that includes a core 16, a ring 30, and arcuate spring fingers 24 having reversibly bent gripping elements 26. The entire detachable tip is removably attached to conventional hammer head 10 as shown in FIG. 1.

3) Patents relating to the art of hammers disclosing hammers with cushions or washers or structures for absorbing shock between a separate but non-replaceable cap and the hammer head proper are as follows:

U.S. Pat. No. 1,045,145 issued to E. O. Hubbard on Nov. 26, 1912, discloses a capped hammer head 1 provided with a shock-absorbing rubber cushion 19 for a separate head proper, or cap 10. FIG. 1 shows a cap 10 has a threaded stud 13 screwed into a retaining head 1 mounted inside a sleeve 5 that in turn is threaded onto a reduced threaded portion 4 of head 1. FIGS. 4 and 5 show variations on the particular structure.

U.S. Pat. No. 1,732,985 issued to R. H. Peters on Oct. 22, 1929, discloses a hammer attachment, or cap, including a sleeve 1 and a rubber striking head 7 is secured by clamping means 12 upon a hammer head 15 with a washer 9 fit against a seat 3 connected to striking head 7 positioned within sleeve 1 is described. It is apparent that washer 9 absorbs pressure exerted by hammer head 15.

U.S. Pat. No. 2,198,764, issued to B. E. Edwards on Apr. 30, 1940, discloses a metal working hammer having a hammer head 6 having a floating striking element 11 that is movably secured to—a stationary hammer striking element 8 positioned in a cylindrical body portion 12 having a bottom, or strike face 13. A shock-absorbing element, or cushion, 15, is housed in cylindrical body portion 12 between bottom strike face 13 and stationary element 8.

U.S. Pat. No. 2,592,883 issued to C. J. Fisher on Apr. 15, 1952, discloses a hand hammer body 10 having a hammer head 16 with an arcuate hammer face 18. A resilient striking member 22 made of resilient carbon spring steel or similar material is mounted over arcuate face 18 so that a recess is defined between striking member 22 and arcuate face 18. In use, when an indented piece of metal is struck with the hammer, the resilient member 22 will flex inwardly toward the recessed face 18 tending to close the hollow space between face 18 and member 22. Immediately thereafter, the spring action of member 22 will cause the member to flex outwardly again. This inward and outward action imparts a spring-like action and resilience to the hammer head.

U.S. Pat. No. 3,148,716 issued to H. A. Vaughan, Jr. on Sep. 15, 1964, discloses a composite hammer head 10 comprised of a main body portion 11 and an impact tip, or cap 12. The front end face 64 of main body portion 11 forms a socket 62. Impact tip 12 is metallic and includes a striking face 46 and a rear tapered shank 44 press-fitted into socket 62. A washer 66 formed of a shock-absorbing material surrounding the base of shank 44 is interposed between striking head 42 and front end face 64. The combined thickness of washer 66 and the depth of socket 62 is slightly greater than the axial extent of shank 44 so that a sealed air pocket 72 is created in the bottom region of socket 62 absorbs some of the impact that is imparted to impact tip 12.

U.S. Pat. No. 2,884,969 issued to C. M. Lay on May 5, 1959, entitled "Hammer Construction with Shock Absorbing Means" is cited in U.S. Pat. No. 3,148,716 to Vaughan for the purpose of describing the effects of impact creating vibration effects in the vicinity of the claw region of a carpenter's claw hammer.

SUMMARY OF THE INVENTION

It is an object of the present invention to provide a replaceable cap for a hammer that has a fastening pin that is free of any shearing pressure during the impact stroke of the hammer.

It is another object of the present invention to provide a replaceable cap for a hammer that allows a user to replace a cap with one type of striking face with another cap with another type of striking face or to replace the hammer head of a replaceable cap with another type of hammer head, for example, a claw hammer with a ball peen hammer.

It is yet another object of the present invention to provide a replaceable cap for a hammer that has a shock absorbing pad.

It is yet another object of the present invention to provide a replaceable cap for a hammer head that has a pole that is slidably mounted within the chamber of the cap with the poll movable relative to the cap between a static mode and an impact mode and that includes a shock-absorbent pad that is biasable and able to move the poll that has moved from the static mode against the pad toward the cap striking face and is further able to self-biasably return the poll to the static mode with the energy of the self-biasing action being supplied by the energy of the striking action against a workpiece.

It is a further object of this invention to provide a retaining ring for holding the fastening pin for holding the replaceable cap for the hammer head described above.

It is yet another object of this invention to provide an external type of retaining ring for holding the fastening pin described above.

It is yet another object of this invention to provide an internal expansion retaining ring for holding the fasting pin described above.

In accordance with these objects and other objects that will become apparent in the course of this disclosure, there is provided retaining means for holding a fastening cross-pin that holds a removable cap mounted to a poll of a hammer thus providing a selected type of cap impact face for the hammer head. The cap forms a chamber and the poll is removably slidably fitted into the poll chamber. The fastening cross-pin is removably positioned in opposed cap pin holes in the cap cylindrical wall and to a poll pin hole so as to secure the cap to the poll and also so as to allow the poll to move relative to the cap in the longitudinal dimension between an impact mode position of the cap impact face against a workpiece and a static mode position of the cap impact face remote from the workpiece. A biasable pad for absorbing shock is positioned within the chamber formed in the cap between the cap impact face and the poll. The fastening cross-pin extends through the poll pin hole and is connected to the cap side walls. The fastening cross-pin is in contact with the front surface of the poll pin hole in the static mode and moves to a free position in the poll pin hole in the impact mode so that the cross-pin avoids shear during the impact mode. Two types of retaining means are described: one type is an external retaining ring that is set into a groove around the cap that is aligned with both ends of the cross-pin; another type is an internal expansion retaining ring that also is a fastening cross-pin that is biased against the pin holes in the cap cylindrical wall.

The present invention will be better understood and the objects and important features, other than those specifically set forth above, will become apparent when consideration is given to the following details and description, which when taken in conjunction with the annexed drawings, describes, illustrates, and shows preferred embodiments or modifications of the present invention and what is presently considered and believed to be the best mode of practice in the principles thereof. Other embodiments or modifications may be suggested to those having the benefit of the teachings therein, and such other embodiments or modifications are intended to be reserved especially as they fall within the scope and spirit of the subjoined claims.

DESCRIPTION OF THE DRAWINGS

FIG. 1 is an elevational side view of the hammer of the present invention with a claw rear region with the handle shown in broken view;

FIG. 1A is an end view of the cap impact face of the hammer cap, with a vertical, horizontal cross-sectional line 4—4;

FIG. 2 is an exploded perspective view of the hammer shown in FIG. 1;

FIG. 2A is a perspective view of the cap taken in isolation showing the cap cylindrical chamber;

FIG. 3 is an isolated side view of the fastening pin;

FIG. 4 is a partial, sectional view taken along the line 4—4 of FIG. 1A, showing the poll, cap, biasable pad and fastening pin of the hammer shown in FIGS. 1 and 2 in the static mode, and with the cross pin shown in a transverse (vertical) cross-section;

FIG. 5 is a partly sectioned side view of the hammer analogous to the view shown in FIG. 4, but in the impact mode with the space formerly occupied by the unbiased biasable pad indicated n phantom line;

FIG. 6 is a top view of the poll, cap self-biasing and fastening pin of the hammer shown in FIGS. 1 and 2 in the static mode, but with the cross-pin shown in axial cross-section;

FIG. 7 is a partly sectioned view of the hammer analogous to the view shown in FIG. 6 in the impact mode;

FIG. 8A is a front view of a cap in isolation having a knurled impact face;

FIG. 8B is a side view of the cap shown in FIG. 8A;

FIG. 9 is an elevational side view of an alternate inventive hammer having a ball peen rear region;

FIG. 10 is an exploded perspective view of another embodiment of a hammer with a claw rear region integral with the hammer center region and the hammer poll with the hammer cap and a cross-pin, hammer cap, and an external two-turn spiral retaining ring for keeping the cross-pin from lateral movement;

FIG. 11 is a partly sectioned top view of the hammer particularly showing the poll, cap, and fastening cross-pin mounted to the cap and also showing sectioned portions of the spiral retaining ring mounted in a groove around the cap at the ends of the cross-pin with the hammer being in the static mode analogous to FIG. 6;

FIG. 12 is a partly sectioned top view of the hammer analogous to the view shown in FIG. 11 with the hammer shown in the impact mode.

FIG. 13 is a broken sectioned view of the groove area of the cap;

FIG. 14A is frontal view of the spiral retaining ring shown in FIGS. 11 and 12;

FIG. 14B is a side view of the spiral retaining ring shown in FIG. 14A;

FIG. 15A is a frontal view of an alternative snap-type retaining ring;

FIG. 15B is a side view of the retaining ring shown in FIG. 15A;

FIG. 16 is a broken side view of the cap and poll of the hammer with one coil of the spiral retaining ring having been separated and about to be wound into the groove of the cap;

FIG. 17 is an exploded perspective view of another embodiment of a hammer, the hammer cap and a biasable expansion-type cross-pin that holds the poll to the cap;

FIG. 18 is a partly sectioned top view of the poll, cap, and fastening cross-pin mounted to the cap and also showing sectioned portions of the biasable expansion retaining cross-pin mounted in a groove around the cap at the ends of the cross-pin with the hammer being in the static mode analogous to FIG. 6;

FIG. 19 is a partly sectioned top view analogous to the view shown in FIG. 18 with the hammer shown in the impact mode;

FIG. 20A is a frontal view of the biasable expansion retaining cross-pin shown in FIGS. 17–19; and FIG. 20B is a side view of the biasable expansion retaining cross-pin shown in FIG. 20A.

DETAILED DESCRIPTION OF THE INVENTION

Reference is now made to the drawings and in particular to FIGS. 1–9 in which identical or similar parts are designated by the same reference numerals throughout.

A hammer 10 shown in FIGS. 1 and 2 includes a hammer head 12 that includes a forward poll 14, a mid-region 16, a rear region claw 18 and a handle 20 connected to mid-region 16. Hammer head 12 has a longitudinal dimension extending from poll 14 to claw 18 with a handle 20 being transverse to the longitudinal dimension. Hammer 10 further includes a cylindrical cap 22 for hammer head 12 with cap 22 being removably fitted over cylindrical poll 14 with the axis of cylindrical cap 22 being axially aligned with the cylindrical axis of cylindrical poll 14. Cap 22 provides a selected type of cap impact face 24 for hammer head 12 so that cap 22 can be removed from hammer head 12 and in particular from poll 14 so that another type of cap can be placed over poll 14. The particular cap impact face 24 shown in FIGS. 1, 2, 4, 5, 6, and 7 is of a type having a slight crown or adz eye, 26, for purposes of exposition only, and in fact cap impact face 24 can be of a number of various types of striking faces known in the art.

As shown in FIGS. 1 and 2 and best seen in FIGS. 4, 5, 6, and 7, cap 22 is, removably secured to pole 14 by a fastening cross-pin 28. FIGS. 4 and 6 show poll 14 and cap 22 in a non-impact, or static, mode with cap impact face 24 remote from a workpiece, such as workpiece 30 shown in FIGS. 5 and 7. FIGS. 5 and 7 show poll 14 and cap 22 in an impact mode with cap impact face 24 in striking contact with workpiece 30. Cross-pin 28 allows poll 14 to move relative to cap 22 in the longitudinal dimension between the impact mode position and the static mode position.

A shock-absorbing, biasable pad 32 both absorbs shock to hammer head 12 during the impact mode and also returns cap 22 by self-biasing action from the impact mode position shown in FIGS. 5 and 7 to the static mode position shown in FIGS. 4 and 6. Biasable pad 32 is positioned within cap 22 between cap impact face 24 and poll 14. Cap 22 forms a cap cylindrical chamber 34 defined by a longitudinally oriented cap cylindrical side wall 36 and a cap front wall 38 transverse to cap side wall 36. Cap front wall 38 includes cap external impact face 24 with adz eye 26 and an opposed cap planar interior chamber face 40 that is transverse to the axis of cylindrical cap 22. Cap chamber 34 has a circular aperture 42, best seen in FIG. 2A, opposed to cap interior chamber face 40. Circular aperture 42 is defined by the circular rim 44 of cap side wall 36.

Cylindrical poll 14 is slidably fitted to cap 22 within cap chamber 34 with the interior surface of cylindrical cap side wall 36 and is in mutual axially aligned sliding contact with the interior surface of cap cylindrical chamber 34 in the longitudinal direction. Poll 14 has a poll planar front surface 46 that is transverse to the axis of cylindrical poll 14 and that is spaced from cap planar chamber interior face 40. Biasable pad 32 is a disk, or cylindrical, in configuration as seen in FIGS. 4–7 that is axially aligned with poll 14 and cap 22. Biasable pad 32 is made of a resilient material such as rubber that is able to absorb the shock of the impact, or striking mode and thus reduces the shock to the hand and arm of the user. In addition, biasable pad 32 is forced into a biased mode with poll self-biasing capability to return to a non-biased mode so as to biasably force poll 14 away from cap chamber face 40 at the termination of the impact mode, that is, at the end of the striking blow of hammer head 12 against workpiece 30. The space between cap planar chamber face 40 and poll planar front surface 46 varies in response to poll 14 and cap 22 being in the static mode or the impact mode so that biasable pad 32 occupies a larger or a smaller space, respectively, therebetween. The action of poll 14 relative to cap 22 between the static mode and the impact mode is analogous to that of a piston in a cylinder block despite the smallness of the movement.

The energy of the impact blow of hammer head 12 against workpiece 30 is partly absorbed by biasable pad 32 to enable biasable pad 32 to force poll 14 back into the static mode during the movement of biasable pad 32 from the biased mode to the unbiased mode. In the static mode of FIGS. 4 and 6, poll planar front surface 46 is in contact with biasable pad 32 and may maintain a slight compression against biasable pad 32 in the range of 0.002 inch to 0.007 inch.

Poll 14 forms a poll pin hole 50 transverse to the longitudinal, or poll axial, direction. Cap cylindrical side wall 36 forms a pair of opposed cap pin holes 52A and 52B in general alignment with poll pin hole 50. Fastening cross-pin 28 extends through poll pin hole 50 and is removably connected to cap 22 at cap pin holes 52A and 52B. Cross-pin 28 has a cross-pin axis 54 and poll pin hole 50 has a poll pin hole axis 56.

Cross-pin 28 has a cross-pin diameter and poll pin hole 50 has a poll pin hole diameter that is greater than the cross-pin diameter. Poll pin hole 50 has an inner cylindrical surface 58 and cross-pin 28 has an outer cylindrical surface 60. In the impact mode as shown in FIGS. 5 and 7 inner cylindrical surface 58 is spaced from outer cylindrical surface 60 and cross-pin axis 54 is generally aligned with poll pin hole axis 56 so that fastening cross-pin 28 is moved to a free position and a transverse annular void 62 is formed between cross-pin outer cylindrical surface 60 and poll pin hole inner cylindrical surface 58. In this manner, cross-pin 28 is moved to a free position wherein shearing pressure against fastening cross-pin 28 is avoided during the impact mode. In the static mode as shown in FIGS. 4 and 6, cross-pin axis 54 is generally axially spaced from poll pin hole axis 56 and the forward portions of cross-pin outer cylindrical surface 60 and poll pin hole inner cylindrical surface 58 have a contact area 64.

As seen in FIGS. 4 and 6 in the static mode, cross-pin axis 54 and poll pin hole axis 56 are in spaced parallel alignment. Because cross-pin 28 is connected to cap 22, cap cross-pin axis 54 is positioned at constant longitudinal first distance $D_1$ from cap chamber interior face 40. Poll pin hole axis 56 in the static mode is positioned at a second distance $D_2$ from cap chamber interior face 40. First distance $D_1$ is less than second distance $D_2$ by a distance $D_3$. Shock-absorbent biasable pad 32 occupies a longitudinal space between cap interior face 40 and pole planar front surface 46 measured by the distance $D_4$.

As seen in FIGS. 5 and 7 in the impact mode, cross-pin axis 54 and poll pin hole axis 56 are in general alignment at the distance $D_1$ measured to cap chamber interior face 40. Shock absorbent biasable pad 32 occupies a longitudinal space between cap interior 40 and poll planar front surface 46 measured by the distance $D_5$, which is less than the distance $D_4$ occupied by biasable pad 32 shown in FIGS. 4 and 6 in the static mode. The distance $D_5$ occupied by biasable pad 32 when added to the distance $D_3$ equals distance $D_4$. The distance $D_3$ between cross-pin axis 54 and poll pin hole axis 56 shown in FIG. 5 in the static mode is the same in the impact mode as shown in FIG. 5 as the reduced distance $D_3$ formerly occupied by biasable pad 32.

As shown in FIG. 3 and in FIGS. 6 and 7, cross-pin 28 includes a main pin portion 66, a threaded end 68 and an opposed pin locator end 70. Cap pin hole 52A is a threaded pin hole that threadably holds pin threaded end 68 and cap pin hole 52B is a locator pin hole that grips pin locator end 70 by a press fit. Locator pin hole 52B has a diameter less than the diameter of cross-pin 28 and pin locator end 70 has a pin locator end diameter generally the same as the diameter of locator pin hole 52B. A locator nose 71 extends from pin locator end 70. The main pin portion diameter is greater than the pin locator portion diameter wherein cross-pin 28 defines a cylindrical shoulder stop 72 between main pin portion 66 and pin locator end 70. As best seen in FIG. 7, stop 72 is positioned at cap cylindrical side wall 36. Threaded end 68 can be rotated with a screw driver into screw recess 74 so that cross-pin 28 can be rotated inwardly until pin locator end 70 is press fitted into locator pin hole 52B so that cross-pin 28 fastens cap 22 to poll 14. Stop 72 prevents over-tightening of cross-pin 28 with poll 14.

FIGS. 8A and 8B show an alternate cap 76 that can be fitted over and secured to a hammer head such as hammer head 12. Alternate cap 76 includes a cylindrical cap side wall 78 and a transverse knurled face 80. A cap side wall threaded pin hole 82 in side wall 78 is shown devoid of a fastening pin.

FIG. 9 is an elevational view of a hammer 84 having a hammer head 86 that includes a poll portion 88, a midportion 90, and a rear portion that comprises a ball peen 92. Hammer 84 includes a handle 94 attached to hammer head midportion 90. In accordance with the present invention, a cap 96, which is identical to cap 22 shown in FIGS. 1–7 is mounted to poll 88 and fastened to poll 88 by cross-pin 98 in a manner analogous to cross-pin 28 of FIGS. 1–7. In this manner, an alternate aspect of the invention is seen other than that of replacing a worn out cap, or replacing one type of cap with another type of cap onto a hammer head is shown in FIG. 9, in that a cap can be removed from one type of hammer head having one type of rear region, for example, a claw, and placed upon another type of hammer head having a different rear region, for example, ball peen 92.

Although the invention as thus far set forth has been described in some detail by way of illustration and example for purposes of clarity and understanding, it will, of course, be understood that various changes and modifications may be made in the form, details, and arrangements of the parts without departing from the scope of the invention. For example, the hammer head may have alternate configurations from the cylindrical poll and cap shown and discussed herein. For instance, a rectangular poll and a rectangular cap can obviously be substituted for the cylindrical poll and cap. Many different types of striking faces for the cap can be used other than the substantially flat striking head with the adz eye and the knurled striking face shown and discussed. The material of the cap can vary, but generally it is a hardened steel or a stainless steel. The cap not only is replaceable when worn out, but it can be made of a heavier metal than the hammer head, which can be, for example, made of a relatively light weight metal such as titanium that does not have the hardness and wearing capability of the steel cap.

Another embodiment of the invention as shown in FIGS. 10, 11, 12, 13, 14A and 14B is a hammer 100 that comprises hammer head 12 previously described in relation to FIGS. 1 and 2 that includes forward poll 14, mid-region 16, and rear region claw 18. Mid-region 16 provides a socket for the handle (not shown). Hammer head 12 has a longitudinal dimension extending from poll 14 to claw 18. Hammer 100 further includes cylindrical cap 22 for hammer head 12 with cap 22 being removably fitted over cylindrical poll 14 with the axis of cylindrical cap 22 being axially aligned with the cylindrical axis of cylindrical poll 14. Cap 22 provides a selected type of cap impact face 24 for hammer head 12 so that cap 22 can be removed from hammer head 12 and in particular from poll 14 so that another type of cap can be placed over poll 14. The particular cap impact face 24 shown in FIGS. 10, 11, and 12 is of a type having a slight crown or adz eye, 26, for purposes of exposition only, and in fact, cap impact face 24 can be of a number of various types of striking faces known in the art.

In accordance with the inventive embodiment of hammer 100, as shown in FIGS. 10–12, cap 22 is removably secured to poll 14 by a fastening cylindrical cross-pin 102, which has the same diameter as cross-pin 28 previously described in relation to FIGS. 6 and 7. FIG. 11 shows poll 14 and cap 22 in a non-impact, or static, mode with cap impact face 24 remote from a workpiece, such as workpiece 30 shown in FIG. 12. FIG. 12 shows poll 14 and cap 22 in an impact mode with cap impact face 24 in striking contact with workpiece 30. Cross-pin 102 allows poll 14 to move relative to cap 22 in the longitudinal dimension between the impact mode position and the static mode position.

Shock-absorbing, biasable pad 32 both absorbs shock to hammer head 12 during the impact mode and also returns cap 22 by self-biasing action from the impact mode position shown in FIG. 12 to the static mode position shown in FIG. 11. Biasable pad 32 is positioned within cap 22 between cap impact face 24 and poll 14. Cap 22 forms a cap cylindrical chamber 34 defined by a longitudinally oriented cap cylindrical side wall 36 and a cap front wall 38 transverse to cap side wall 36. Cap front wall 38 includes cap external impact face 24 with adz eye 26 and an opposed cap planar interior chamber face 40 that is transverse to the axis of cylindrical cap 22. Cap chamber 34 has a circular aperture 42 opposed to cap interior chamber face 40. Circular aperture 42 is defined by the circular rim 44 of cap side wall 36.

Cylindrical poll 14 is slidably fitted to cap 22 within cap chamber 34 with the interior surface of cylindrical cap side wall 36 and is in mutual axially aligned sliding contact with the interior surface of cap cylindrical chamber 34 in the longitudinal direction. Poll 14 has a poll planar front surface 46 that is transverse to the axis of cylindrical poll 14 and that is spaced from cap planar chamber interior face 40. Biasable pad 32 is a disk, or cylindrical, in configuration that is axially aligned with poll 14 and cap 22. Biasable pad 32 is made of a resilient material such as rubber that is able to absorb the shock of the impact, or striking mode and thus reduces the shock to the hand and arm of the user. In addition, biasable pad 32 is forced into a biased mode with poll self-biasing capability to return to a non-biased mode so as to biasably force poll 14 away from cap chamber face 40 at the termination of the impact mode, that is, at the end of the striking blow of hammer head 12 against workpiece 30.

The space between cap planar chamber face 40 and poll planar front surface 46 varies in response to poll 14 and cap 22 being in the static mode or the impact mode so that biasable pad 32 occupies a larger or a smaller space, respectively, therebetween. The action of poll 14 relative to cap 22 between the static mode and the impact mode is analogous to that of a piston in a cylinder block despite the smallness of the movement. The energy of the impact blow of hammer head 12 against workpiece 30 is partly absorbed by biasable pad 32 to enable biasable pad 32 to force poll 14 back into the static mode during the movement of biasable pad 32 from the biased mode to the unbiased mode. In the static mode of FIG. 11, poll planar front surface 46 is in contact with biasable pad 32 so as to maintain a slight compression against biasable pad 32 in the range of 0.002 inch to 0.007 inch.

In accordance with the invention of hammer 100, cap wall 104 defines a circumferential groove 106 as shown in FIGS. 10 and 16. Groove 106 is semi-circular in configuration. Poll 14 forms a cylindrical poll pin hole 50 as shown in FIGS. 6 and 7 transverse to the longitudinal, or poll axial, direction in general though not exact alignment with groove 106. Cap cylindrical side wall 36 forms a pair of opposed cap cylindrical pin holes 108 transverse to the poll axis and in general though not exact alignment with poll pin hole 50. Cap pin holes 108 each extends between groove 106 and poll pin hole 50. Cap pin holes 108 are transverse to the longitudinal, or cap axial, direction of cap 22. Pole pin hole 50 has such dimension that accommodation is given relative to cylindrical cross-pin 102 to provide space for longitudinal movements of poll 14 within cap chamber 34, that is, poll pin hole 50 has a slightly greater diameter than cross-pin 102.

Fastening cross-pin 102 extends through poll pin hole 50 and is removably connected to cap 22 at cap pin holes 108. Cross-pin 102 has a cross-pin axis 110 and poll pin hole 50 has a poll pin hole axis 56. Cross-pin 102 has a cross-pin diameter and poll pin hole 50 has a poll pin hole diameter that is greater than the cross-pin diameter. Poll pin hole 50 has an inner cylindrical surface 58 and cross-pin 102 has a pin outer cylindrical surface 109. In the impact mode as shown in FIG. 12, poll pin hole inner cylindrical surface 58 is spaced from pin outer cylindrical surface 109, and cross-pin axis 110 is generally aligned with poll pin hole axis 56 so that fastening cross-pin 102 is moved to a free position and a transverse annular void 62 is formed between cross-pin outer cylindrical surface 109 and poll pin hole inner cylindrical surface 58. In this manner, cross-pin 102 is moved to a free position wherein shearing pressure against fastening cross-pin 102 is avoided during the impact mode. In the static mode as shown in FIG. 11, cross-pin axis 110 is generally axially spaced from poll pin hole axis 56 and the forward portions of cross-pin outer cylindrical surface 109 and poll pin hole inner cylindrical surface 58 have a contact area 112.

As seen in FIG. 11 in the static mode, cross-pin axis 110 and poll pin hole axis 56 are in spaced parallel alignment. As similarly shown in FIGS. 4 and 5, because cross-pin 102 is connected to cap 22, cap cross-pin axis 110 is positioned at constant longitudinal first distance $D_1$ from cap chamber interior face 40. Poll pin hole axis 56 in the static mode is positioned at a second distance $D_2$ from cap chamber interior face 40. First distance $D_1$ is greater than second distance $D_2$ by a distance $D_3$. Shock-absorbent biasable pad 32 occupies a longitudinal space between cap interior face 40 and poll planar front surface 46 measured by the distance $D_4$.

As present in FIG. 12 and shown more particularly in FIG. 5, in the impact mode, cross-pin axis 110 and poll pin hole axis 56 are in general alignment at the distance $D_1$ measured to cap chamber interior face 40. Shock absorbent biasable pad 32 occupies a longitudinal space between cap interior 40 and poll planar front surface 46 measured by the distance $D_5$, which is less than the distance $D_4$ occupied by biasable pad 32 shown in FIG. 4 in the static mode. The distance $D_5$ occupied by biasable pad 32 when added to the distance $D_3$ equals distance $D_4$. The distance $D_3$ between cross-pin axis 110 and poll pin hole axis 56 shown in FIG. 4 and present in FIG. 11 in the static mode is the same in the impact mode as shown in FIG. 5 and present in FIG. 12 as the reduced distance $D_3$ formerly occupied by biasable pad 32.

As shown in FIGS. 10 and 11, cross-pin 102 includes opposed cross-pin ends 114 that are positioned in cap pinholes 108. Groove 106 opens at both cap pin holes 108 as can be seen in FIG. 10. As seen in FIG. 13, groove 106 has a groove width GW and a groove depth GD. As seen in FIG. 12, cross-pin 102 has a pin diameter PD that is slightly less than groove width GW so that cross-pin 102 is slidably positioned in cap pin holes 108. Cylindrical cap 22 has cap cylindrical inner and outer surfaces 118 and 120, respectively. Cross-pin ends 114 are positioned between cap inner and outer surfaces 118 and 120 so that cross-pin ends 114 are at a distance from cap outer surface 120 that is equal to groove depth GD seen in FIG. 13.

An external retaining ring 122, shown in isolation in FIGS. 14A and 14B, is positioned in groove 106 and is in contact with cross-pin ends 114 so that retaining ring 122 externally holds cross-pin 102 in mounted relationship with cap 22. Retaining ring 122 is also shown in FIG. 10, and in cross-section in FIGS. 11, 12 and 13. Retaining ring 122 is a spiral retaining ring having a 360 degree retaining surface. Retaining ring 122 as shown in FIGS. 14A and 14B is a 2-turn spiral ring with an offset configuration and is preferably made of carbon and stainless steel with a self-biasing capability. Retaining ring 122 can alternatively have other configurations such as those shown in the catalogue of Smalley Steel Ring Company, Wheeling, Ill. Groove depth GD can be deep so as to accommodate a heavy duty type of retaining ring 122 that may be necessary for certain tasks.

Retaining ring 122 is shown in FIG. 16 being mounted into groove 106. Retaining ring 122 includes opposed first and second coils 124 and 126 having free ends 128 and 130, respectively. First coil 124 is shown having been separated from second coil 126 thus enabling its free end 132 to be inserted into groove 106. Retaining ring 122 is thereupon rotated, or wound, into groove 106 until both coils 124 and 126 have been fully seated in groove 106 thus in contact with cross-pin ends 114 so as to hold cross-pin 102 in position.

FIG. 16 indicates the manual method of how to mount retaining ring 122 into groove 106. One coil 124 has been separated from coil 126 and free end 128 is being positioned for placement into groove 106 at which position coil 124 will be wound into groove 106 followed by coil 126 until retaining ring 122 is fully seated in groove 106. Upon retaining ring 122 being seated in groove 106, cross-pin 102 is fully secured in a locking relationship with cap 22.

Retaining ring 122 can be removed from groove 106 by prying either coil end 128 or 130 with an instrument out of its seating in groove 106 so that the associated coil can be unwound from groove 106 along with the entire retaining ring 122 so as to free cross-pin 102 for removal from its locking relationship with cap 22 and poll 14 and cross-pin 102 can be freely slid from cap 22 so as to allow cap 22 to be removed from poll 14 and biasable pad 32 can be removed from cap chamber 34 and a new pad 34 be inserted therein and cap 22 and poll 14 be reassembled with cross-pin 102 inserted into cap pin holes 108 and poll pin hole 50 and retaining ring 122 be again remounted in groove 106.

A snap retaining ring 132 shown in FIGS. 15A and 15B is another embodiment of an external retaining ring that can be seated into groove 106. Snap retaining ring 132 is basically circular with opposed free ends 134 and 136 that define a ring gap 138. Ears 140 and 142 extend outwardly from free ends 134 and 136, respectively. Snap retaining ring 132 is biasable between a closed mode as shown in FIGS. 15A and 15B and an open mode (not shown). To place snap retaining ring 132 in the open mode, a user holds ears 140 and 142 and pulls ends 134 and 136 apart into the biased open mode at which time snap retaining ring 132 can be seated in groove 106 and then ears 140 and 142 released so that snap retaining ring 132 self-biases into its non-biased mode and is locked into a fully retaining position so as to secure cross-pin 102 in its fastening relationship with cap 22 and poll 14. Snap retaining ring 132 is removed from groove 106 by the user holding ears 140 and 142 and pulling them apart so as to move snap retaining ring 132 into its biased mode so as to allow the user to remove retaining ring 132 from groove 106 so that cross-pin 102 can be freely slid from cap 22. Cross-pin 102 is then freed for removal from its locking relationship with cap 22 and poll 14 and can be freely slid from cap 22 so as to allow cap 22 to be removed from poll 14. Biasable pad 32 then can be removed from cap chamber 34 and a new pad 34 can be inserted therein. Cap 22 and poll 14 are then reassembled and cross-pin 102 inserted into cap pin holes 108 and poll pin hole 50 and a retaining ring 132 is then mounted in groove 106.

Another embodiment of the invention is shown in FIG. 17 as a hammer 144 that comprises hammer head 12 previously described in relation to FIGS. 1 and 2 that includes forward poll 14, mid-region 16, and rear region claw 18. Mid-region 16 provides a socket for the handle (not shown). Hammer head 12 has a longitudinal dimension extending from poll 14 to claw 18. Hammer 144 further includes cylindrical cap 22 for hammer head 12 with cap 22 being removably fitted over cylindrical poll 14 with the axis of cylindrical cap 22 being axially aligned with the cylindrical axis of cylindrical poll 14. Cap 22 provides a selected type of cap impact face 24 for hammer head 12 so that cap 22 can be removed from hammer head 12 and in particular from poll 14 so that another type of cap can be placed over poll 14. The particular cap impact face 24 shown in FIGS. 17, 18, and 19 is of a type having a slight crown, or adz eye, 26, for purposes of exposition only, and in fact, cap impact face 24 can be of a number of various types of striking faces known in the art.

In accordance with the inventive embodiment of hammer 144 and as shown in added detail in FIGS. 18, 19, 20A and 20B, cap 22 is removably secured to poll 14 by a fastening cylindrical cross-pin 146, sometimes referred to generally as a roll pin or expansion pin, which has approximately the same diameter as cross-pin 28 described in relation to FIGS. 6 and 7 and as cross-pin 102 described in relation to FIGS. 11 and 12. FIG. 18 shows poll 14 and cap 22 in a non-impact, or static, mode with cap impact face 24 remote from a workpiece, such as workpiece 30 shown in FIG. 19. FIG. 19 shows poll 14 and cap 22 in an impact mode with cap impact face 24 in striking contact with workpiece 30. Cross-pin 146 allows poll 14 to move relative to cap 22 in the longitudinal dimension between the impact mode position and the static mode position.

Shock-absorbing, biasable pad 32 both absorbs shock to hammer head 12 during the impact mode and also returns cap 22 by self-biasing action from the impact mode position shown in FIG. 19 to the static mode position shown in FIG. 18. Biasable pad 32 is positioned within cap 22 between cap impact face 24 and poll 14. Cap 22 forms a cap cylindrical chamber 34 defined by a longitudinally oriented cap cylindrical side wall 36 and a cap front wall 38 transverse to cap side wall 36. Cap front wall 38 includes cap external impact face 24 with adz eye 26 and an opposed cap planar interior chamber face 40 that is transverse to the axis of cylindrical cap 22. Cap chamber 34 has a circular aperture 42 opposed to cap interior chamber face 40. Circular aperture 42 is defined by the circular rim 44 of cap side wall 36.

Cylindrical poll 14 is slidably fitted to cap 22 within cap chamber 34 with the interior surface of cylindrical cap side wall 36 and is in mutual axially aligned sliding contact with the interior surface of cap cylindrical chamber 34 in the longitudinal direction. Poll 14 has a poll planar front surface 46 that is transverse to the axis of cylindrical poll 14 and that is spaced from cap planar chamber interior face 40. Biasable pad 32 is a disk, or cylindrical, in configuration that is axially aligned with poll 14 and cap 22. Biasable pad 32 is made of a resilient material such as rubber that is able to absorb the shock of the impact, or striking mode and thus reduces the shock to the hand and arm of the user. In addition, biasable pad 32 is forced into a biased mode with poll self-biasing capability to return to a non-biased mode so as to biasably force poll 14 away from cap chamber face 40 at the termination of the impact mode, that is, at the end of the striking blow of hammer head 12 against workpiece 30. The space between cap planar chamber face 40 and poll planar front surface 46 varies in response to poll 14 and cap 22 being in the static mode or the impact mode so that biasable pad 32 occupies a larger or a smaller space, respectively, therebetween. The action of poll 14 relative to cap 22 between the static mode and the impact mode is analogous to that of a piston in a cylinder block despite the smallness of the movement. The energy of the impact blow of hammer head 12 against workpiece 30 is partly absorbed by biasable pad 32 to enable biasable pad 32 to force poll 14 back into the static mode during the movement of biasable pad 32 from the biased mode to the unbiased mode. In the static mode of FIG. 18, poll planar front surface 46 is in contact with biasable pad 32 so as to maintain a slight compression against biasable pad 32 in the range of 0.002 inch to 0.007 inch.

In accordance with the inventive embodiment of hammer 144, poll 14 forms a cylindrical poll pin hole 50 as previously described in relation to FIGS. 5 and 6 and FIGS. 11 and 12. Poll pin hole 50 is transverse to the longitudinal, or poll axial, direction. Cap cylindrical side wall 36 forms a pair of opposed cap cylindrical pin holes 148 transverse to the poll longitudinal axis and in general though not exact alignment with poll pin hole 50. Cap pin holes 148 are transverse to the longitudinal, or cap axial, direction of cap 22. Poll pin hole 50 has such dimension that accommodation is given relative to cylindrical cross-pin 146 to provide space for longitudinal movements of poll 14 within cap chamber 34, that is, poll pin hole 50 has a slightly greater diameter than cross-pin 146.

Fastening cross-pin 146 extends through poll pin hole 50 and is removably connected to cap 22 at cap pin holes 148. Cross-pin 146 has a cross-pin axis 160 and poll pin hole 50 has a poll pin hole axis 56. As best seen in FIG. 20B, cross-pin 146 has a cross-pin cylindrical, or annular, wall 152 having a cross-pin wall inner annular surface 154 and a cross-pin wall outer cylindrical surface 156. Cross-pin cylindrical wall 152 defines a cross-pin cylindrical cavity 158.

Cross-pin outer cylindrical surface 156 defines the outer diameter of cross-pin 146. Poll pin hole 50 has a poll pin hole diameter that is greater than the diameter of cross-pin wall outer cylindrical surface 156.

In the impact mode as shown in FIG. 19, cross-pin axis 160 is generally aligned with poll pin hole axis 56 so that fastening cross-pin 146 is moved to a free position and a transverse annular void 62 is formed between cross-pin outer cylindrical surface 156 and poll pin hole inner cylindrical surface 58. In this manner, cross-pin 146 is moved to a free position wherein shearing pressure against fastening cross-pin 146 is avoided during the impact mode. In the static mode as shown in FIG. 18, cross-pin axis 156 is generally axially spaced from poll pin hole axis 56 and the forward portions of cross-pin outer cylindrical surface 154. In the static mode as shown in FIG. 18, cross-pin axis 160 is generally axially spaced from poll pin hole axis 56, and the forward portions of cross-pin outer cylindrical surface 156 and poll pin hole inner cylindrical surface 58 have a contact area 112.

As seen in FIG. 18 in the static mode, cross-pin axis 160 and poll pin hole axis 56 are in spaced parallel alignment. As similarly shown in FIGS. 4 and 5, because cross-pin 146 is connected to cap 22, cross-pin axis 160 is positioned at constant longitudinal first distance D1 from cap chamber interior face 40. Poll pin hole axis 56 in the static mode is positioned at a second distance D2 from cap chamber interior face 40. First distance D1 is less than second distance D2 by a distance D3. Shock-absorbent biasable pad 32 occupies a longitudinal space between cap interior face 40 and poll planar front surface 46 measured by the distance D4.

As present in FIG. 19 and shown more particularly in FIG. 5, in the impact mode, cross-pin axis 160 and poll pin hole axis 56 are in general alignment at the distance D1 measured to cap chamber interior face 40. Shock absorbent biasable pad 32 occupies a longitudinal space between cap interior 40 and poll planar front surface 46 measured by the distance D5, which is less than the distance D4 occupied by biasable pad 32 shown in FIG. 4 in the static mode. The distance D5 occupied by biasable pad 32 when added to the distance D3 equals, distance D4. The distance D3 between cross-pin axis 160 and poll pin hole axis 56 shown in FIG. 4 and present in FIG. 18 in the static mode is the same in the impact mode as shown in FIG. 5 and present in FIG. 19 as the reduced distance D3 formerly occupied by biasable pad 32.

As shown in FIGS. 18, 19, and 20A, cross-pin 146 includes opposed cross-pin ends 164 that are positioned in cap pin holes 148. Cylindrical cap 22 has cap cylindrical inner and outer surfaces 166 and 168, respectively. Cross-pin ends 164 are positioned between cap inner and outer cylindrical surfaces 166 and 168.

Cross-pin 146 is configured as an expansion retaining pin that is in biased holding relationship with cap 22 at opposed cap pin holes 148. Thus, cross-pin 146 has a double function as a cross-pin 146 for mounting poll 14 with cap 22 and as a self-biased expansion retaining pin. As best seen in FIGS. 20A and 20B, cross-pin cylindrical wall 152 further has opposed linear side walls 170A and 170B extending lengthwise relative to cross-pin 146 between cross-pin ends 164 and define therebetween a linear gap, or slot, 172 that likewise extends between cross-pin ends 164. Cross-pin/expansion pin 146 is biasably movable between first and second modes as follows: the first mode is wherein cylindrical cross-pin 146 and particularly cross-pin wall 152 is in an unbiased mode wherein linear slot 172 is defined by a first distance between linear side walls 170A and 170B. The second mode is wherein cross-pin wall 152 is in a biased mode wherein linear slot 172 is defined by a second distance between linear side walls 170A and 170B that is less than the first distance. Cross-pin 146 is positioned in opposed cap pin holes 148 in the biased second mode wherein cylindrical cross-pin outer wall 156 is biasably pressed against cap 22 at said cap pin holes 148 so as to biasably grip cap 22 and thus hold cross-pin 146 to cap 22. Cross-pin 146 is removable from cap pin holes 148 while in the biased second mode by forced lateral movement relative to cap pin holes 148 at which time cross-pin 146 self-biases to the first unbiased mode. Cross-pin 146 is preferably made of a biasable metal such as steel but can be made of any biasable material that is capable of withstanding shock and hard usage.

Cross-pin 146 can be mounted into cap pin holes 148 by using a pressing tool to force cross-pin 146 from the unbiased mode to the biased mode sufficient to reduce the outer diameter of cross-pin 146 to a dimension that is slightly less than the diameter of cap pin holes 148 and thereupon by forcing cross-pin 146 into cap pin holes 148 at which time cross-pin 146 self-biases into the biased second mode against the inner cylindrical surface of cap pin holes 148 wherein cap 22 is locked with poll 14. A tool is used to knock cross-pin 146 from cap pin holes 148. At such time, a worn biasable pad 32 can be removed from cap chamber 34 and replaced by a new biasable pad 32. Cross-pin 146 can then be mounted to cap 22 and poll 14 in the above described manner.

Although the invention as related to FIGS. 10–20B thus far set forth has been described in some detail by way of illustration and example for purposes of clarity and understanding, it will, of course, be understood that various changes and modifications may be made in the form, details, and arrangements of the parts without departing from the scope of the invention. As one example, external retaining ring 122 can have various configurations including the number of coils and the type of material which can be other than steel and can be of any material with the strength to withstand shock and usage.

The invention claimed is:

1. A hammer including a handle, comprising:

a hammer head having a longitudinal dimension including a poll, a cap slidably fitted over said poll, fastening means for removably securing said cap to said poll and for allowing said poll to move relative to said cap in the longitudinal dimension between an impact mode position of said cap against a work object and a static mode position of said cap remote from the work object, a biasable pad positioned within said cap, between said cap and said poll, said fastening means further including said poll having a pin hole transverse to the longitudinal dimension and said cap having a side wall having a pair of opposed cap pin holes in general alignment with said poll pin hole, said fastening means further including a cross-pin extending through said poll pin hole and removably mounted to said cap at said pair of cap pin holes.

2. A hammer in accordance with claim 1, wherein said cross-pin has opposed pin ends, said cap having a cap external side wall surface and a cap internal side wall surface, each of said opposed pin ends being positioned between said internal and external side wall surfaces.

3. The hammer in accordance with claim 2, wherein said cross-pin has a cross-sectionial area parallel to the cross-pin opposed ends and being smaller than a cross-sectional area of said poll pin hole.

4. The hammer in accordance with claim 2, wherein the cross-pin is an expansion pin.

5. The hammer in accordance with claim 2, wherein the fastening means further comprises an external retaining ring positioned in a groove in the cap external side wall surface.

6. The hammer in accordance with claim 5, wherein said external retaining ring is a biasable external retaining ring.

7. The hammer in accordance with claim 6, wherein said biasable external retaining ring is a biasable spiral retaining ring having a 360 degree retaining surface.

8. The hammer in accordance with claim 7, wherein said spiral retaining ring includes a plurality of coils.

9. The hammer in accordance with claim 5, wherein said external retaining ring is a snap retaining ring including opposed ring ends defining a gap therebetween.

10. The hammer in accordance with claim 9, wherein said snap retaining ring includes a pair of gripping ears connected to said opposed ring ends.

11. The hammer in accordance with claim 5, wherein said external retaining ring is made of carbon steel.

12. The hammer in accordance with claim 5, wherein said external retaining ring is made of stainless steel.

13. A hammer including a handle, comprising:

a hammer head having a longitudinal dimension including a poll, cap means having a cap impact face and being removably and slidingly fitted to said poll, fastening means for removably securing said cap means to said poll and for allowing said poll to move relative to said cap means in the longitudinal dimension between an impact mode position of said cap impact face against a work object and a static mode position of said cap impact face remote from the work object, biasable pad means for absorbing shock to said hammer head during the impact mode and for self-biasably returning said poll from the impact mode position to the static mode position, said biasable pad being positioned between said cap means and said poll, said fastening means further comprising said poll having a poll pin hole transverse to the longitudinal dimension and said cap side wall having a pair of opposed cap pin holes in general alignment with said poll pin hole, said fastening means further comprising a cross-pin extending through said poll pin hole and removably mounted to said cap at said pair of cap pin holes.

14. The hammer in accordance with claim 13, wherein said cross-pin further comprises an expansion pin.

15. The hammer in accordance with claim 14, wherein said expansion pin has opposed expansion pin ends positioned in said opposed cap pin holes, said cap having an external cap side wall surface and an internal cap side wall surface, said expansion pin having opposed expansion pin ends positioned between said internal and external cap side wall surfaces.

16. The hammer in accordance with claim 15, wherein said expansion pin further comprises an annular wall defining a cylindrical cavity, said annular wall having a slot extending between said expansion pin ends.

17. The hammer in accordance with claim 14, wherein said expansion pin is made of stainless steel.

18. The hammer in accordance with claim 14, wherein said expansion pin is made of carbon steel.

19. A hammer comprising:

a handle;

a head connected to said handle;

a cap slidably connected to said head;

a pin adapted to connect said cap to said head and to permit slidable movement of said cap relative to said head; and a resilient pad disposed between said head and said cap.

20. A hammer in accordance with claim 19, wherein said cap defines a cavity therein, and a portion of said head is slidably received within said cavity.

21. A hammer in accordance with claim 19, wherein said pad is replaceable.

22. A hammer in accordance with claim 19, wherein said fastener further comprises an expansion pin.

23. A hammer in accordance with claim 19, wherein said pin is removably connected to said cap.

24. A hammer in accordance with claim 19, wherein said head has a longitudinal dimension and an aperture therethrough, said aperture being arranged perpendicular to said longitudinal dimension.

25. A hammer in accordance with claim 24, wherein said pin has a cross-section and said aperture has a cross-section that is larger than said cross-section of said pin.

26. A hammer in accordance with claim 25, wherein said pin is connected to said cap and arranged to have a portion of said pin disposed in said aperture.

27. A hammer in accordance with claim 19, wherein said pad remains in contact with said cap and said head.

28. A hammer in accordance with claim 27, wherein said aperture has a forward surface and wherein in a static mode said pin contacts said forward surface of said aperture and said cap and head are in contact with said pad.

29. A hammer in accordance with claim 28, wherein when said hammer is used to strike an object with said cap, said pin is moved rearward within said aperture and said pad is compressed.

30. A hammer in accordance with claim 29, wherein in said static mode said pad is held under slight compression between said cap and said head.

31. A hammer in accordance with claim 30, wherein when said hammer is used to strike an object with said cap, said pin is moved rearward within said aperture and said pad is further compressed.

32. A hammer in accordance with claim 19, wherein said head and said cap are made of different materials.

* * * * *